US006207935B1

(12) United States Patent
Dittmar et al.

(10) Patent No.: US 6,207,935 B1
(45) Date of Patent: Mar. 27, 2001

(54) RADIANT HEATING ELEMENT WITH A METAL FOIL HEAT CONDUCTOR

(75) Inventors: Gunter Dittmar, Aalen; Josef Hecht, Erlenmoos; Gunther Wildner, Lautern, all of (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 09/269,113

(22) PCT Filed: Sep. 16, 1997

(86) PCT No.: PCT/EP97/05067

§ 371 Date: Jun. 11, 1999

§ 102(e) Date: Jun. 11, 1999

(87) PCT Pub. No.: WO98/12899

PCT Pub. Date: Mar. 26, 1998

(30) Foreign Application Priority Data

Sep. 21, 1996 (DE) ..... 196 38 640

(51) Int. Cl.[7] ..... H05B 3/68

(52) U.S. Cl. ..... 219/461.1; 219/542

(58) Field of Search ..... 219/460.1, 461.1, 219/465.1, 466.1, 542, 543; 339/279, 280, 281, 283, 285, 330

(56) References Cited

U.S. PATENT DOCUMENTS

| | | | |
|---|---|---|---|
| 3,316,390 | | 4/1967 | Gaugler et al. . |
| 4,002,883 | * | 1/1977 | Hurko ..... 219/466.1 |
| 4,034,206 | | 7/1977 | Penrod . |

FOREIGN PATENT DOCUMENTS

| | | |
|---|---|---|
| 27 20 394 A1 | 11/1977 | (DE) . |
| 92 14 270 U | 5/1994 | (DE) . |

* cited by examiner

*Primary Examiner*—Sang Paik
(74) *Attorney, Agent, or Firm*—Scully, Scott, Murphy & Presser

(57) ABSTRACT

A radiant heating body for a cooking hob has a heating conductor comprising a metal foil and an insulating bottom (12). To make the heating conductor easy to fit and to provide advantageous heat radiation properties the flat geometrical heating conductor pattern is separated out of the metal foil. The pattern forms heating limbs (1) whose large surface is towards the cooking hob and which are held at least at an outer annular rim (13) of the insulating bottom (12).

59 Claims, 24 Drawing Sheets

RADIANT HEATING ELEMENT WITH A METAL FOIL HEAT CONDUCTOR

BACKGROUND OF THE INVENTION

1. Field of the Invention

The invention concerns a radiant heating body for a cooking hob, in particular a glass ceramic cooking hob, having a heating conductor comprising a metal foil and an insulating bottom under the heating conductor, wherein the heating conductor extends in a geometrical pattern between the cooking hob and the insulating bottom.

2. Discussion of the Prior Art

A radiant heating body of that kind is described in DE 42 29 375 A1 and EP 0 585 831 A2. The heating conductor comprises a flexible flat strip which is laid in a spiral configuration on the insulating bottom in such a way that its large surface is perpendicular to the insulating bottom and to the cooking hob. Only its narrow upper edge is towards the cooking hob. By virtue of that arrangement the large surfaces radiate heat to each other.

For the purposes of fixing the heating conductor strip in position it has at its lower edge holding plate portions or tongues which are fitted into the insulating bottom itself. Assembly of the heating conductor is a complicated and expensive operation as the flat strip must be laid in spiral-shaped turns and the holding tongues have to be pressed into the insulating bottom.

At the high temperatures, greater than 600° C., involved in radiant operation, corresponding expansion phenomena at the heating conductor occur, which may not result in the heating conductor coming loose from the insulating bottom.

EP 0 175 662 B1 describes a heating conductor whose flat geometrical pattern is separated by stamping out of a foil laminate including a metal foil. That heating body is only suitable for temperatures below 200° C., a maximum of 400° C., and cannot therefore be used as a radiant heating body.

EP 0 175 662 B1 provides for stamping out of the foil laminate two heating bodies in metal form, which are in mutually internested relationship, which reduces the amount of stamping wastage.

EP 0 229 928 A2 discloses a heating element for cooking units, which has a heating conductor path using flat conductor technology, preferably thick-film paste technology, which is applied to a carrier element which is stable in respect of shape. That publication does not describe a radiant heating body in which glowing operation of the heating conductor path is an important consideration.

U.S. Pat. No. 3,567,906 describes a flat heating wire which is wound in a sinusoidal configuration and which is laid in parallel strips beneath the cooking surface. The flat heating wire is not to be visible through the cooking surface. This therefore does not involve a radiant heating body in which it is important for the heating conductor to glow visibly for the user.

DE 41 22 106 A1 discloses a radiant heating body whose heating turns are held down on the insulating bottom by means of a shaped member.

SUMMARY OF THE INVENTION

The object of the present invention is to propose a radiant heating body of the kind set forth in the opening part of this specification, whose heating conductor can be easily fitted over the insulating bottom, wherein temperature expansion phenomena of the heating conductor are to be reliably accommodated and advantageous radiation properties are to be achieved, in particular in regard to rapidly attaining a condition of visible glowing, and in regard to the level of efficiency involved.

In accordance with the invention, in a radiant heating body of the kind set forth in the opening part of this specification, that object is attained in that the geometrical heating conductor pattern is separated out of a metal foil, and that the heating conductor pattern forms heating limbs whose thickness is substantially smaller than their width and whose large surface is directed upwardly and which are held at least at an outer annular rim of the insulating body.

As the heating conductor is separated out of a metal foil, for example stamped out, cut out or etched out, it is fairly stable in the plane of its flat geometrical pattern, that plane being parallel between the plane of the cooking hob or surface and the plane of the insulating bottom. The geometrical pattern is for example star-shaped, in a meander form or in the form of a spiral. It may also adopt the configuration of a company logo, for example a character or symbol, a characteristic sequence of letters, or letters and/or digits.

The heating conductor can be integrally separated out of a metal foil if there is available a metal foil which is of a width corresponding to the diameter of the heating conductor. It may however also be composed of a plurality of portions which form a respective part of the geometrical pattern. In that case the heating conductor portions are preferably connected together in those enlarged-width zones which in operation remain cold in comparison with the heating limbs.

The heating conductor when prefabricated in that way can be easily fitted over the insulating bottom, in which respect laying procedures such as for example winding it in a spiral are eliminated.

The heating limbs of the heating conductor have their large surface facing towards the cooking surface or hob. That therefore provides that the heating conductor occupies a large part of the surface area of the cooking hob, thereby affording advantageous radiation properties. The spacings between the narrow edges of the heating conductor only have to be of such a size that the necessary electrical insulation between the heating limbs is guaranteed. With that arrangement the available surface area of the cooking hob can be substantially covered by heating conductors.

Comparative tests have shown that the glow-up or initial glow time is substantially shorter than in the case of known radiant heating bodies. As the radiating surface area is large in relation to the cross-section, that affords good heat dissipation which makes it possible for the heating limbs to be loaded with a comparatively high level of current density. That also provides for a short time to start cooking, with a high level of efficiency.

A further advantage is that the structural height of the radiant heating body can be small, or, with the same structural height, the thickness of the insulating bottom and thus its thermal insulating effect can be increased.

Preferably the actual heating limbs float freely over the insulating bottom, especially in the cold condition and preferably also in the hot condition. With the thermally induced expansion phenomena which inevitably occur as a result of the high radiant temperatures which are over 600° C. and which can reach up to 1200° C., the heating limbs can sag in the direction of the insulating bottom without the heating conductor coming loose in that situation. The air space between the heating limbs and the insulating bottom has a heat-insulating action. In order to reduce the degree of sag the stiffness of the heating limbs which are flexible in themselves can be increased by the heating limbs being profiled in a U-shape or a V-shape, in regard to their cross-section. The profiling may extend over the entire length or a part of the length.

The heating conductor is preferably fixed by means of holding tongues which are fashioned on its geometrical pattern and which are seated for example on an annular rim of the insulating bottom. The annular rim can be fitted as a separate part on to the insulating bottom or can be formed in one piece thereon.

Preferably the outer annular rim is formed by an annular outer zone of the insulating bottom, which zone projects beyond the insulating bottom, and an annular portion which is fitted on to the outer zone and which comprises thermally and electrically insulating material, with the holding tongues engaging between the outer zone and the annular portion. By virtue of that arrangement, in the assembly operation the heating conductor can be easily fitted on to the annular outer zone, in which case it is at the required spacing from the insulating bottom. The heating conductor is fixed in position by fitting the annular portion in place.

The frictional and/or positively locking fixing action can be improved by means of pushed-through spike portions or claws on the holding tongues, wherein by pressing on the annular portion the spike portions or claws penetrate upwardly into the annular portion and/or downwardly into the annular outer zone of the insulating bottom.

The heating conductor can also be fixed in a similar manner to a central inwardly disposed location of the heating limb.

In a preferred configuration of the invention the holding tongues are wider than the heating limbs in such a way that their temperature in operation remains below the incandescent temperature. That therefore avoids the holding tongues which are disposed in the annular rim reaching a temperature which unnecessarily heats up the insulating material. In addition, enlarged-width zones of that kind which in particular are comparatively cool may possibly also have necessary electrical connections so that they do not adversely affect the service life of the heating conductor.

BRIEF DESCRIPTION OF THE DRAWINGS

Further advantageous configurations of the invention are set forth in the appendant claims and the following description of embodiments given by way of example. In the drawing:

DETAILED DESCRIPTION OF PREFERRED EMBODIMENTS

A heating conductor is separated in a desired geometrical pattern (see FIGS. 1 to 5) out of a thin metal foil which is of uniform thickness, with a specific electrical resistance which is suitable for a heating conductor, for example by a cutting operation, a stamping operation or an etching operation. The thickness of the metal foil is for example about 0.03 to 0.1 mm. Preferably the heating conductor is in one piece, in which case its entire flat geometrical pattern which is disposed beneath a circular cooking area or hob portion of a glass ceramic panel is separated out of a metal foil of suitable width. If however only a metal foil of lesser width is available or can be worked it is also possible for the heating conductor to be composed of two or more portions, in which case each portion forms a part of the geometrical pattern.

A plurality of heating limbs 1, outer holding plate portions or tongues 2 and two current connections 3 are shaped out on the heating conductor. The heating limbs 1 are of such a width that in operation they visibly light up. The holding tongues 2 and the current connections 3 are wider than the heating limbs 1 so that in operation as far as possible they do not reach incandescent temperature.

Figure 1:
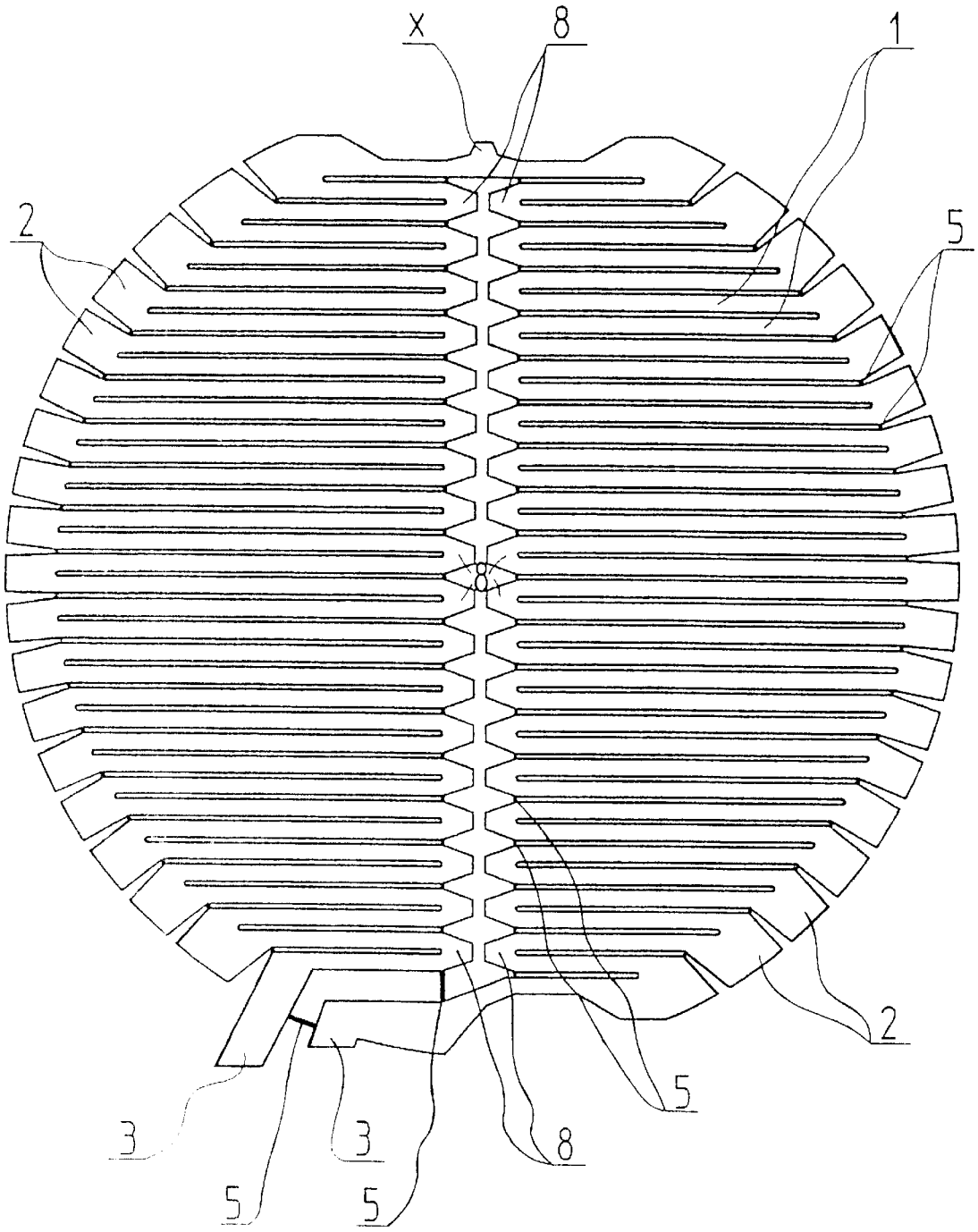
FIGS. 1 to 5 show plan views of a heating conductor with different geometrical patterns and holding tongues in a condition of not yet being fitted into the radiant heating body.

In a heating conductor as shown in FIG. 1 the heating limbs 1 extend in respectively parallel relationship in a right-hand and a left-hand semicircle. The outer holding tongues 2 are disposed on the periphery of the circle, while each two adjacent heating limbs are connected at the outside by an outer holding tongue.

Each two adjacent heating limbs 1 are connected at the inside by an inner holding tongue 8, wherein the heating limbs 1 are electrically connected in series between the current connections 3. It is however also possible to have a series/parallel circuitry.

The inner holding tongues 8 are disposed in two rows on a diagonal zone of the circular shape (see FIG. 1). The heating conductor can be fixed in the manner described in greater detail hereinafter at the outer and inner holding tongues 2, 8 respectively.

The embodiment shown in FIG. 1 provides that the circular heating surface is substantially occupied by heating conductors. That gives a heat radiation effect with a high level of efficiency and a uniform glow effect or image.

The heating conductor pattern shown in FIG. 1 is also suitable for manufacture from two individual symmetrical portions. They can be electrically connected together, for example by welding, at the connecting location X.

The heating conductor blank shown in FIG. 1 has stabilisation limbs 5 at the outer holding tongues 2 and the inner holding tongues 8, and between the current connections 3. The stabilisation limbs 5 serve to stiffen the flexible heating conductor upon transportation and assembly. The cross-section of each stabilisation limb 5 is substantially smaller than that of a heating limb 1. After the heating conductor is mounted in the radiant heating body the stabilisation limbs 5 are removed as they represent electrical short-circuits. That can be effected by applying an electrical voltage for example to the current connections 3. The stabilisation limbs 5 then burn through.

Figure 2:
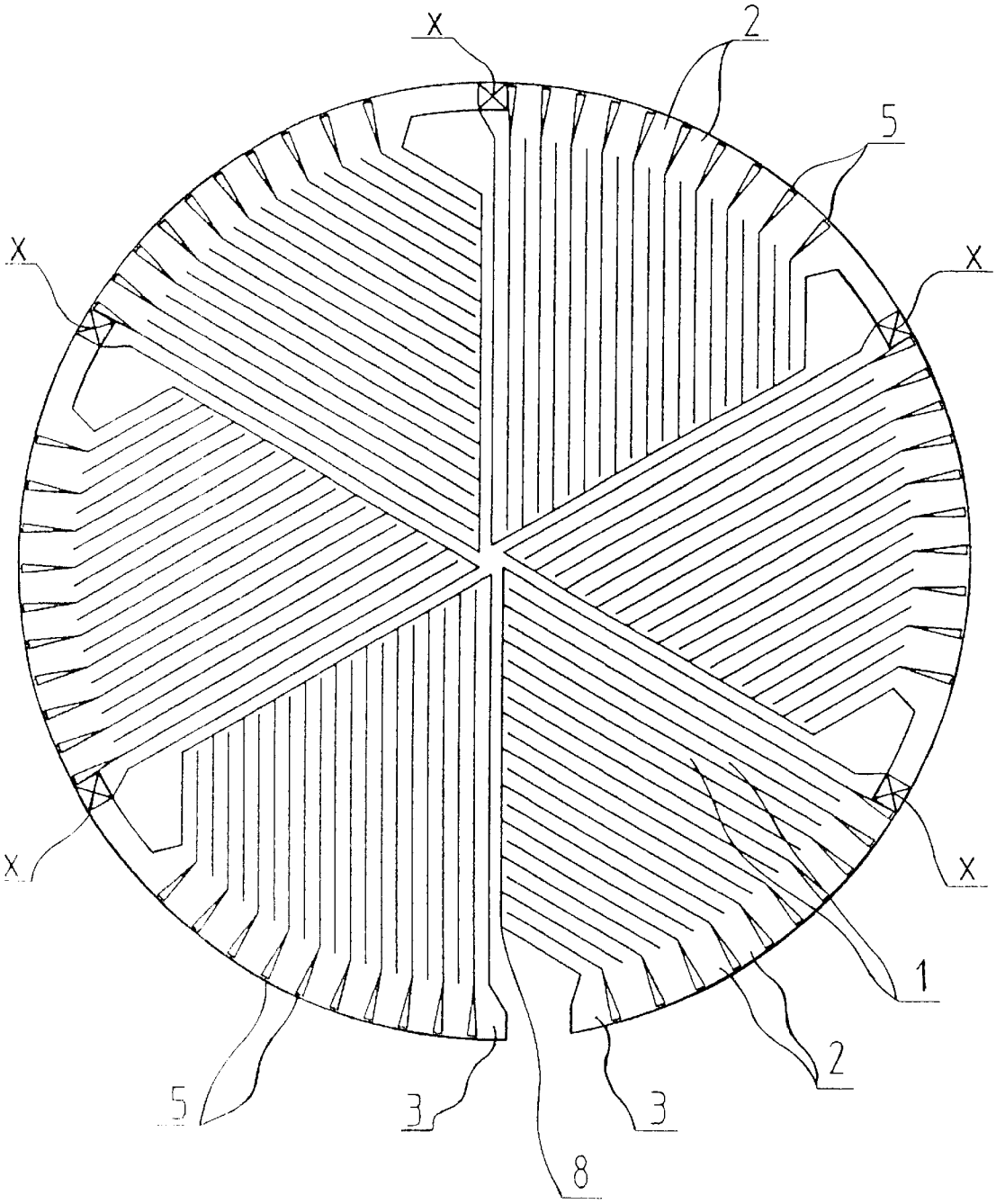

In the embodiment shown in FIG. 2 the heating conductor is composed of six identical segments which are connected together at the connecting locations X. In each segment, the heating limbs 1 extend in mutually parallel relationship. In this case also there are stabilisation limbs 5 at the outer holding tongues 2. The inner holding tongues 8 are only diagrammatically indicated. This heating conductor pattern provides for good utilisation of the heating surface and provides a star-like glow effect or image.

Figure 3:
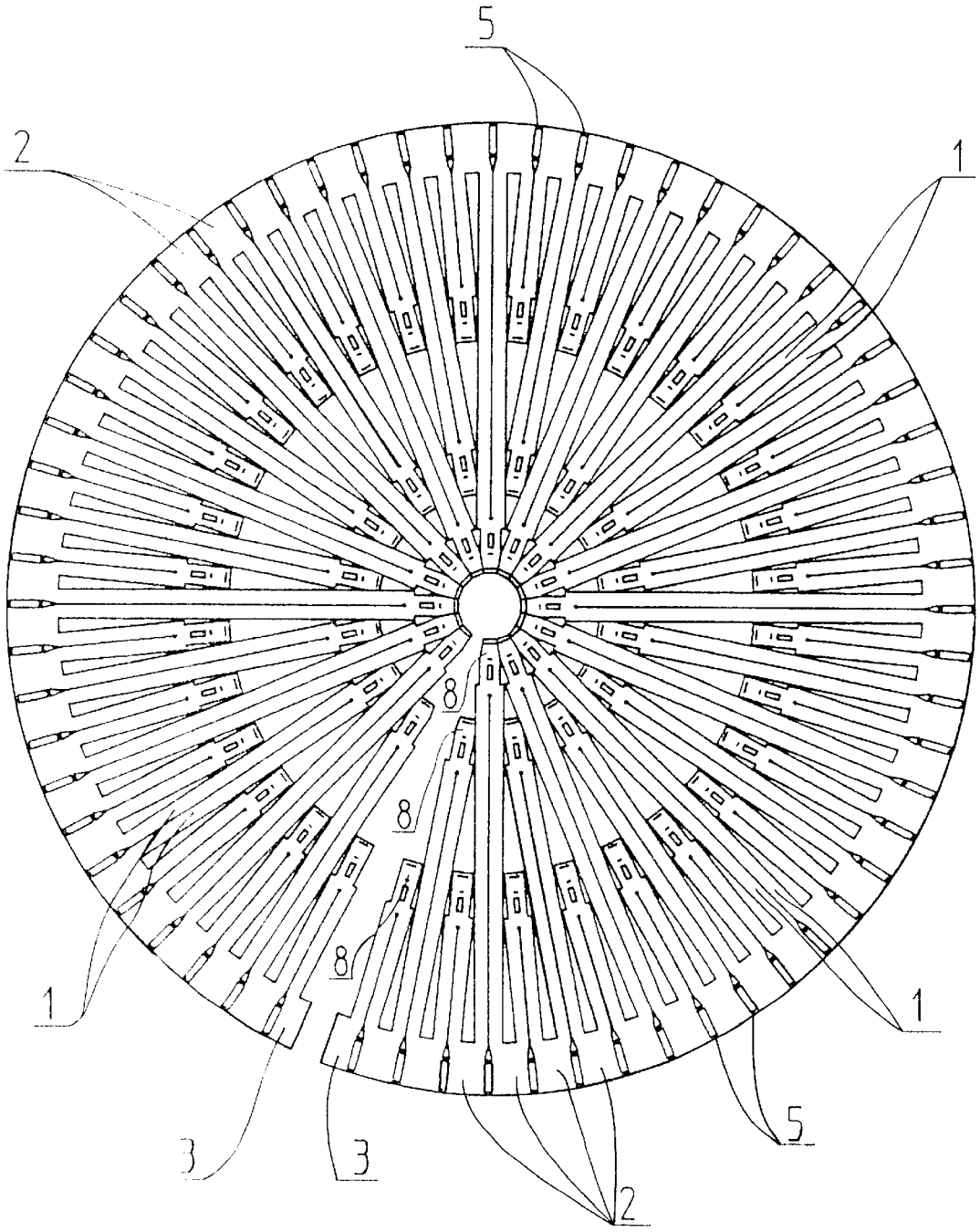

FIG. 3 shows a star-shaped heating conductor pattern. A respective pair of parallel heating limbs 1 form an arm of the star-shaped pattern. All outer holding tongues 2 which connect a respective pair of heating limbs are disposed on the circular periphery. The star arms are alternately radially different in length, wherein the inner holding tongues 8 which each connect a respective pair of heating limbs lie on circles of different diameters. In operation this gives a star-shaped glow effect or image, with the level of power density attained in the outer region being higher than in the construction shown in FIG. 4.

Figure 4:
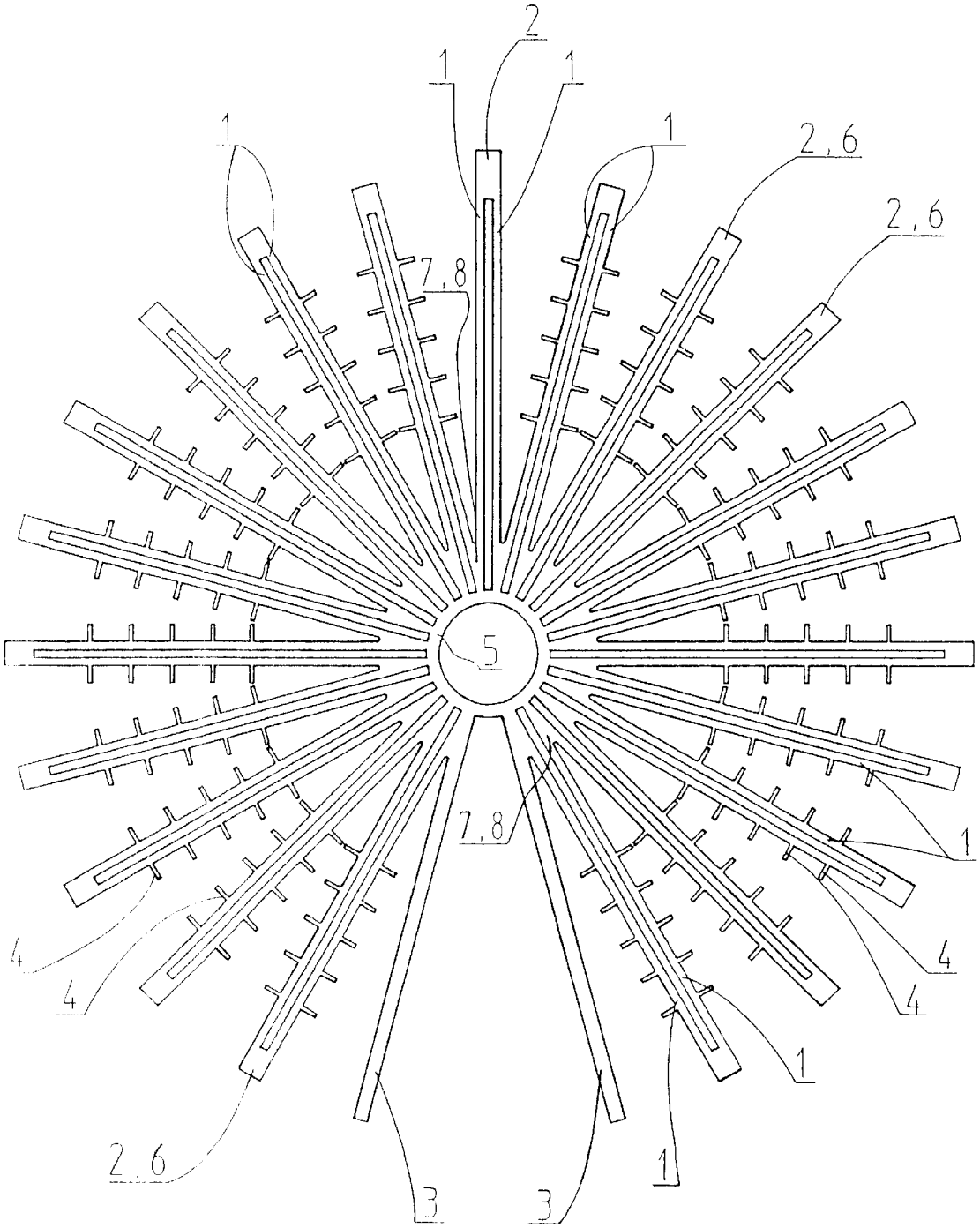

In the embodiment shown in FIG. 4, a respective pair of heating limbs 1 extending in parallel relationship forms an arm of the star-shaped pattern. Provided on the heating limbs 1 are lateral holding tongues 4 which can be bent downwardly perpendicularly to the plane of the pattern and which serve for guidance in openings or grooves in the insulating bottom described in greater detail hereinafter. Those lateral holding tongues 4 however may also be omitted.

As shown in FIG. 4, there is an inner ring on the heating conductor, as a stabilisation limb 5. The inner ring only serves to enhance the level of stability of the heating limb in transportation and assembly. Because the inner ring 5 forms an electrical short-circuit, it is burnt out prior to assembly, for example by way of desired-breakage locations. In operation the heating limbs 1 are electrically in series between the current connections 3, and they are electrically connected together by way of the holding tongues 2 which are provided at outside locations of the geometrical pattern and which form outer connecting limbs 6 and by way of inner connecting limbs 7 which at the same time form inner holding tongues 8.

Figure 5:
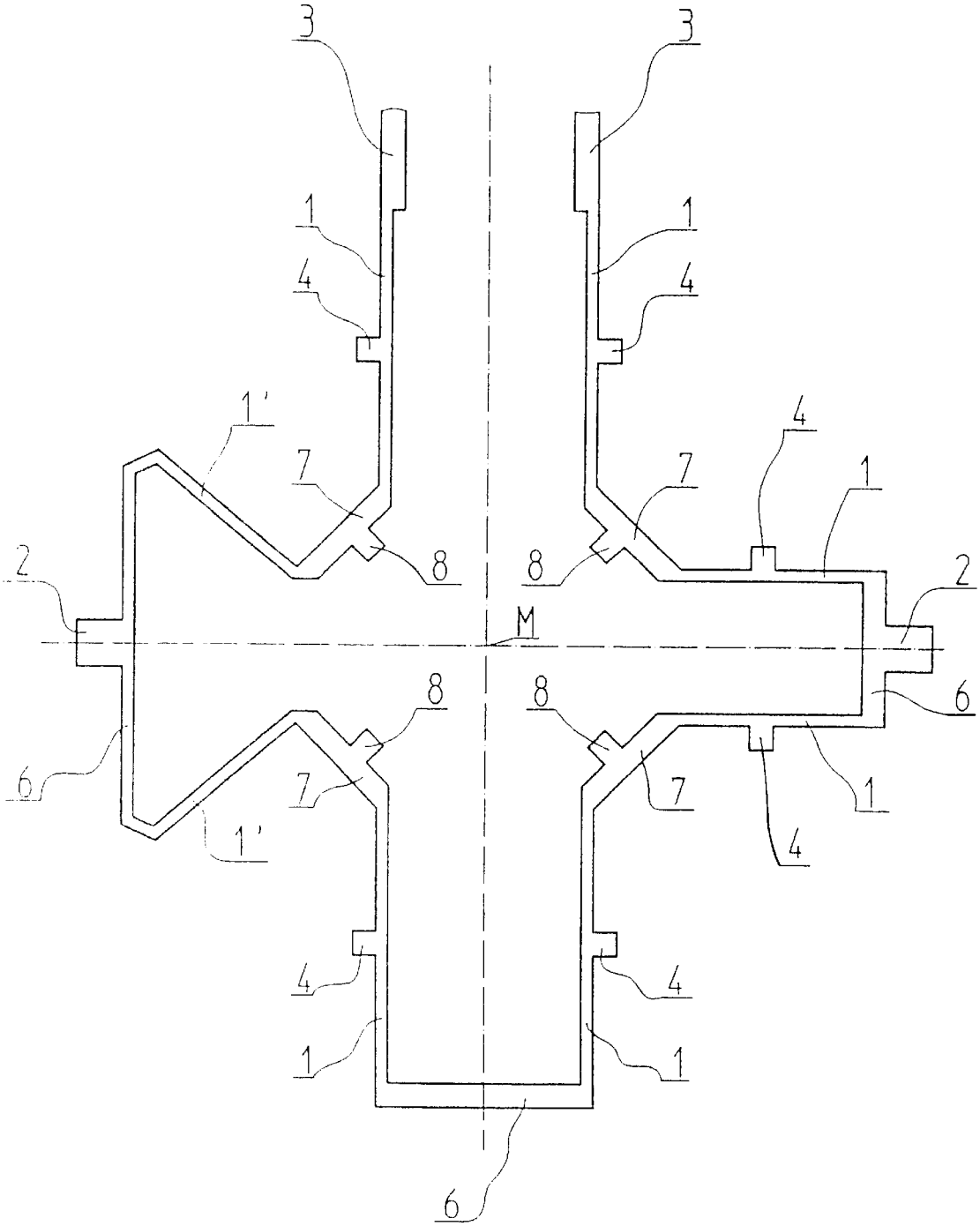

FIG. 5 shows various configurations of the heating limbs 1 to illustrate the options involved. A part of the heating limbs 1 extends in pairs in mutually parallel relationship. Other heating limbs 1' extend substantially radially relative to the centre point M. For reasons of symmetry, one configuration or the other can be adopted in practice for all heating limbs 1, 1'.

As shown in FIG. 5 the outer holding tongues 2 project outwardly beyond the outer connecting limbs 6. The inner holding tongues 8 project inwardly relative to the inner connecting limbs 7. Depending on the respective requirements involved, the widths of the inner connecting limbs 7 and/or the outer connecting limbs 6 may be such that in operation they light up like the heating limbs 1, 1', or do not light up.

FIGS. 6, 7, 8, 10, 15 and 24 to 30 diagrammatically show a radiant heating body 10 that is mounted under a transparent glass ceramic plate or panel 9. An insulating bottom 12 of a thermally and electrically insulating material known in connection with radiant heating bodies is arranged in a dish-like portion 11 of sheet metal of the radiant heating body 10. An outer annular rim 13 is provided on the insulating bottom 12 for mounting the outer holding tongues 2. In the embodiments shown in FIGS. 6, 7, 8, 10 and 24, 27 the annular rim 13 is formed by an annular outer zone 14 which projects beyond the insulating bottom 12 in the direction of the glass ceramic plate 9, and an annular portion 15 which can be fitted on to the outer zone 14. The outer holding tongues 2 are held in frictional engagement or positively locking engagement between the annular outer zone 14 and the annular portion 15. To improve the firmness of the fit, the pushed-through spike portions 21 or claws which are described in greater detail hereinafter can be provided on the holding tongues 2, the spike portions 21 or claws being pressed downwardly into the outer zone 14 or upwardly into the annular portion 15.

Figure 6:
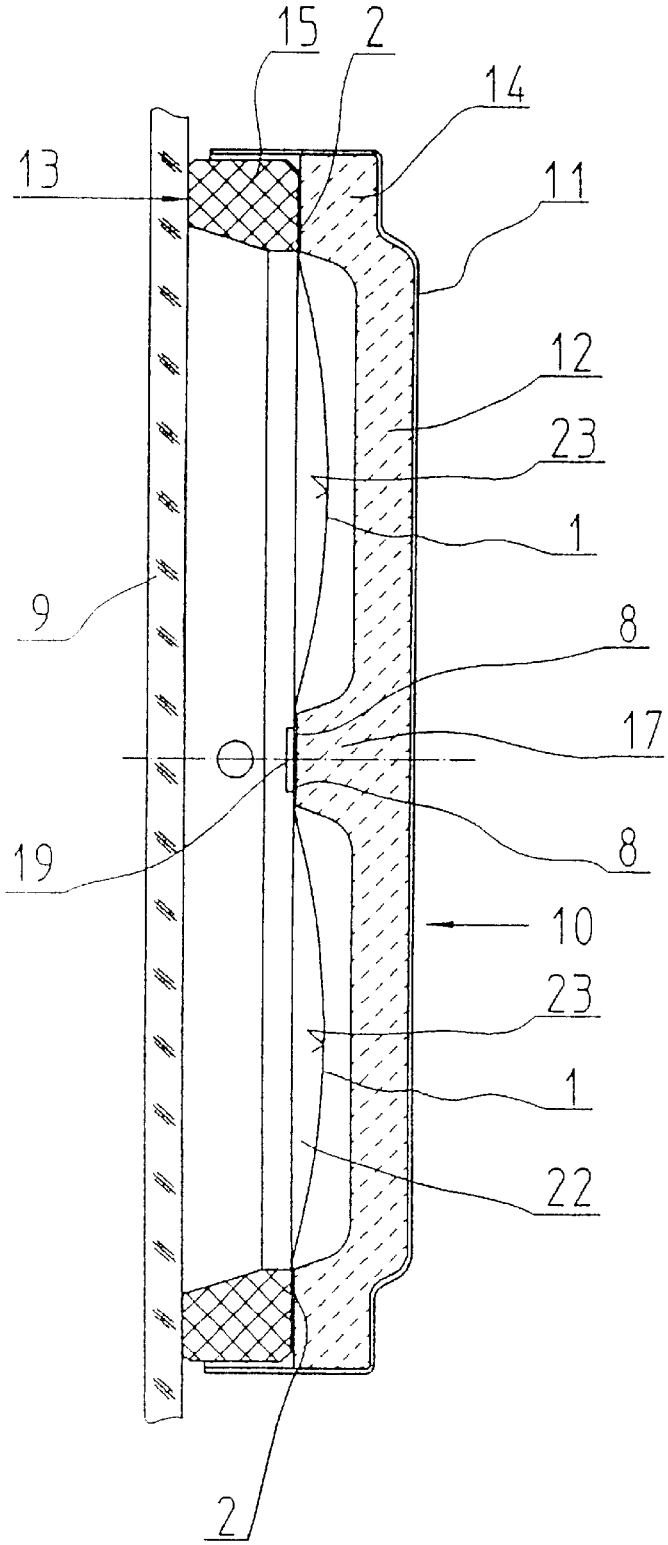
FIGS. 6, 7, 8, 10 are diagrammatic views in cross-section of a radiant heating body with fitted heating conductor.

In the embodiment shown in FIG. 6 a support or base portion 17 is provided on the insulating bottom 12 for supporting the inner holding tongues 8. For a heating conductor as shown in FIG. 1 the support portion 17 extends in the diagonal zone on which the inner holding tongues 8 are also disposed. The two parallel rows of the inner holding tongues 8 (see FIG. 1) are fixed to the support portion 17 by means of an inner holding portion 19 formed by a straight holding strip or bar portion. The holding strip or bar portion comprises a ceramic material which is more stable in respect of shape than the material of the insulating bottom 12. The holding strip or bar portion is fixed to the support portion 17 for example by glueing or clips or is held by means of the annular portion 15. The bar-shaped expansion temperature sensor which is known per se in relation to radiant heating bodies extends in parallel relationship over the holding strip or bar portion 19.

In operation the heating limbs 1 are subject to thermal expansion phenomena which are considerable at the usual temperatures of over 600° C., in the longitudinal direction, and that results in a considerable degree of sag, particularly in the case of non-profiled heating limbs 1. FIG. 6 shows the sag 23 of the heating limbs 1 in the hot condition. The arrangement is preferably so selected that even in the hot condition the heating limbs 1 do not touch the insulating bottom 12. In the cold condition there is a correspondingly larger distance between the large underneath surface of the heating limbs 1 and the insulating bottom 12.

Figure 7:
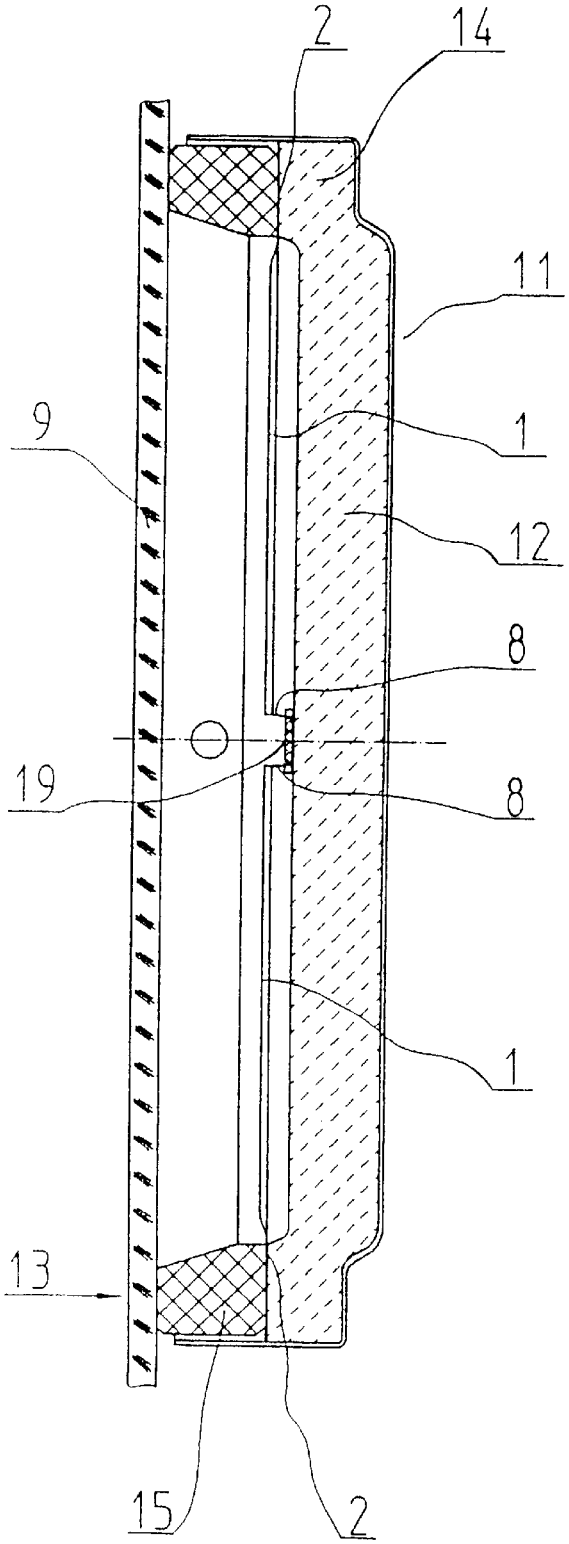

FIG. 7 shows an alternative to FIG. 6. In this case the heating limbs are profiled, as is shown with reference to FIG. 9, in order to increase the stability of the heating limbs and thus to reduce the degree of sag.

In FIG. 7 the inner holding tongues 8 are bent over downwardly in such a way that they hold the heating limbs 1 spaced from the insulating bottom 12. They are fitted into a holding portion 19 which is secured to the insulating bottom 12 and which comprises an electrically insulating material, for example rubber or micanite (synthetic resin-bound mica). Suitable insertion openings can be provided on the holding portion 19. Thermal expansion which occurs at the heating limbs 1 is accommodated by virtue of bendability of the inner holding tongues 8. To absorb thermal expansion, it can also be provided that the inner and/or outer holding tongues are displaceable to a limited extent, at their holding portions.

Figure 8:
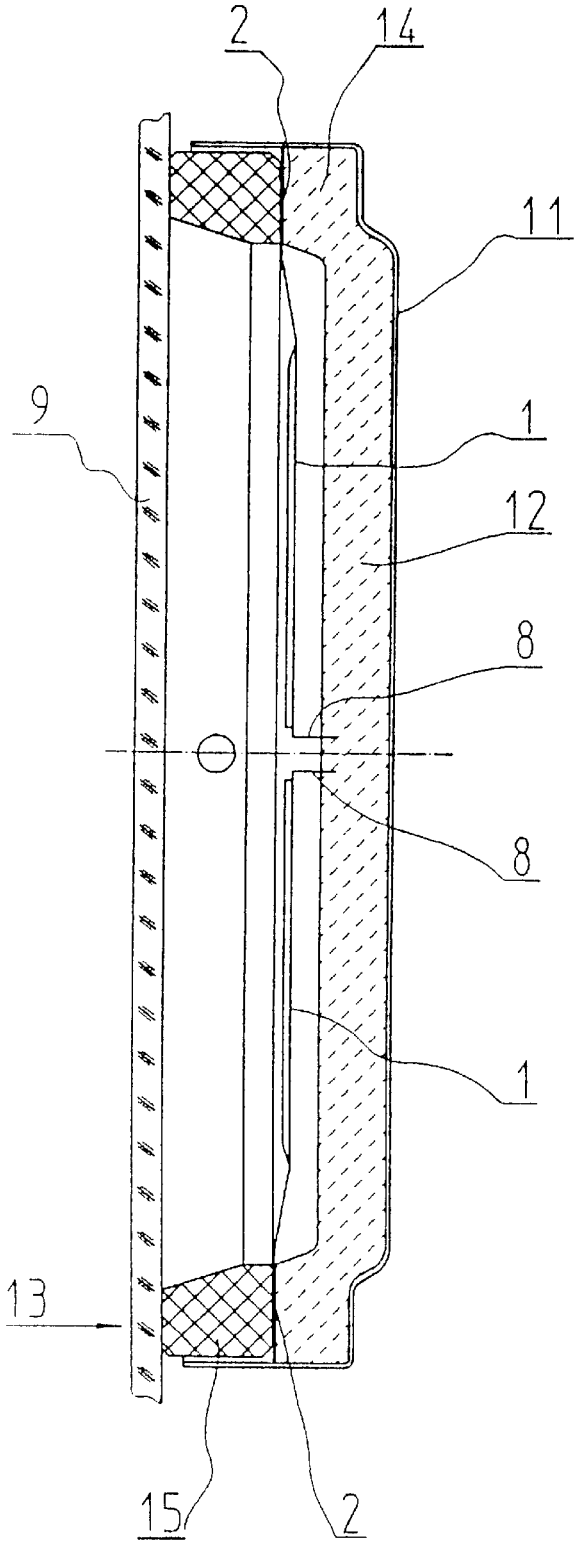

In the embodiment shown in FIG. 8 the heating limbs 1 are profiled only over a part of their length and are non-profiled in a lengthwise region L. That lengthwise region L extends in a slightly angled configuration and accommodates thermal expansion of the heating limbs. The profiled lengthwise regions can rest entirely or nearly on the insulating bottom 12.

Figure 9:
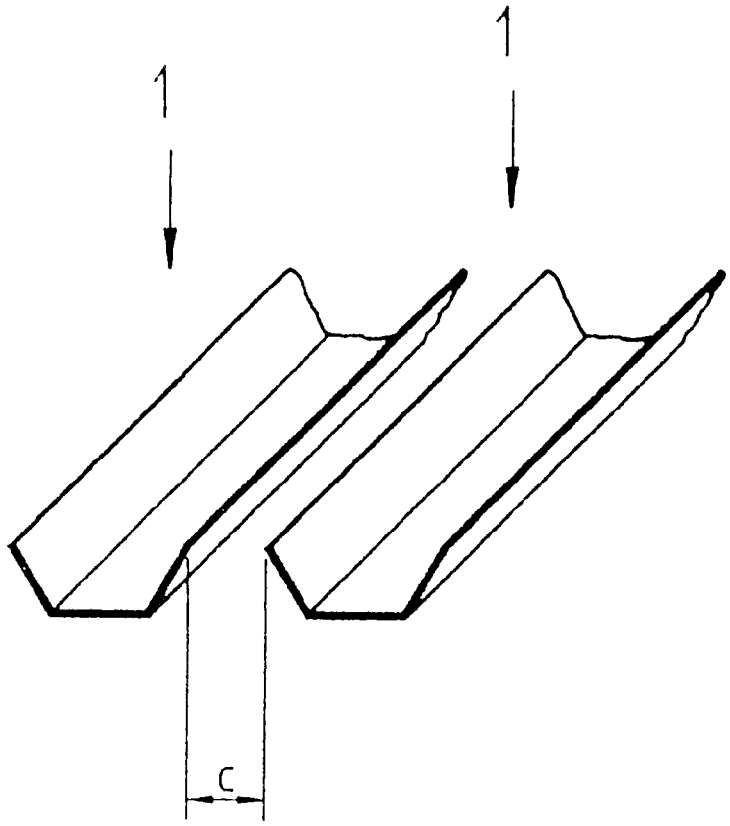
FIG. 9 is a view in cross-section of adjacent profiled heating limbs taken along line IX—IX in FIGS. 7 and 8, on an enlarged scale.

FIG. 9 is a view in cross-section of two adjacent profiled heating limbs 1. That profile is made in a V-shaped or U-shaped configuration by pressing in the heating limbs 1, prior to fitting the assembly in the radiant heating body. That configuration affords the advantage that as a result the heating limbs become more stable in the longitudinal direction and that adjacent, mutually parallel heating limbs 1 can be separated from each other without loss of material when separating the heating conductor out of the metal foil with a single cut and the necessary electrical insulation spacing c is then afforded by pressing in the V-shaped profile. Furthermore this configuration has the advantage that the radiation properties of each heating limb 1 are influenced in a specific and controlled manner, insofar as either the concave surface or the convex surface faces towards the glass ceramic plate 9.

Figure 10:
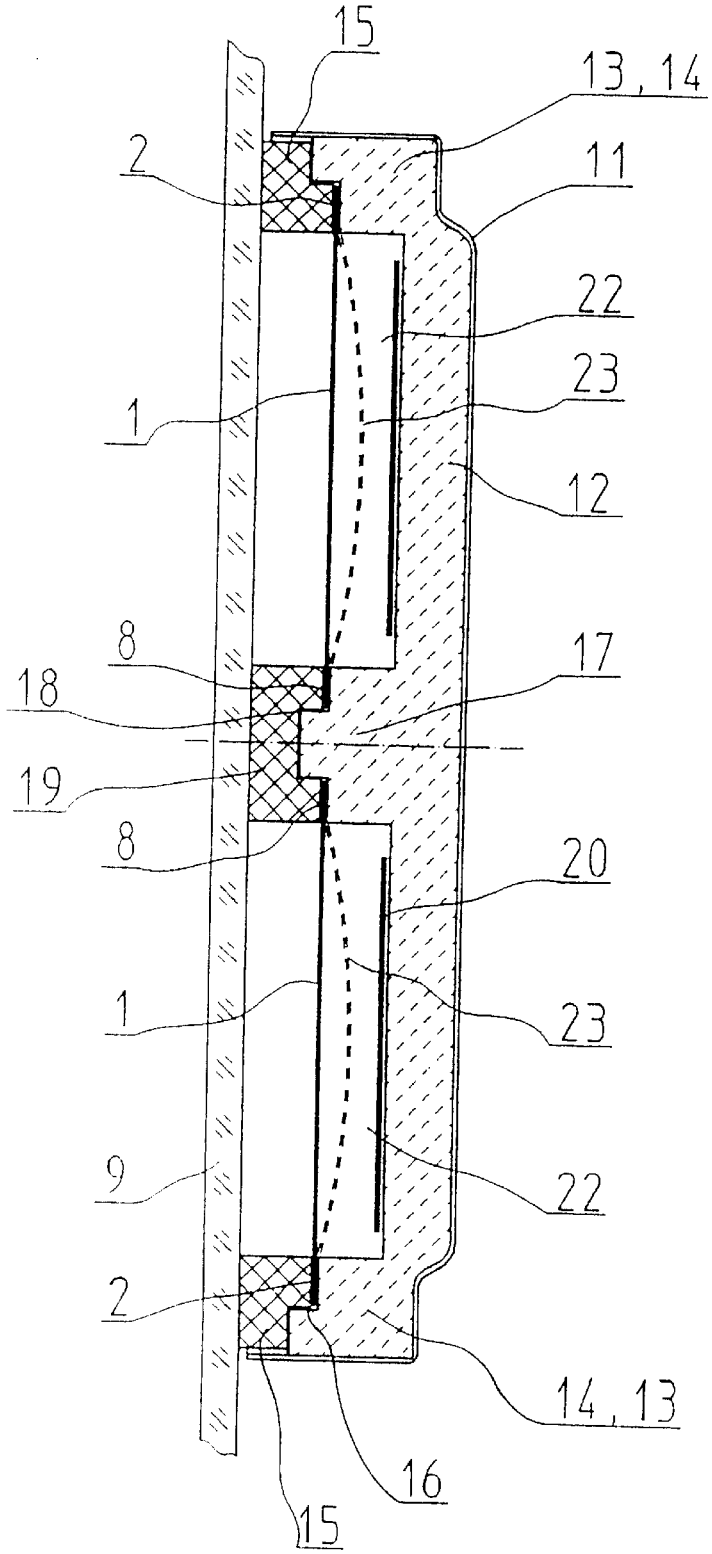

The embodiment shown in FIG. 10 has a step 16 between the outer zone 14 and the annular portion 15 in order to be able to fit the heating conductor in place without contact with the dish-like portion 11. The heating conductor engages with its outer holding tongues 2 between the outer zone 14 and the annular portion 15, with the outer holding tongues 2 not being bent over out of the plane of the geometrical pattern.

Provided in the middle of the insulating bottom 12 is a support portion 17 which, like the outer zone 14, projects in the direction of the glass ceramic plate 9 and which, like the outer zone 14, has a step 18. A cap 19 which like the annular portion 15 comprises an electrically and thermally insulating material can be fitted on to the support portion 17, as an inner holding portion.

Figure 11:
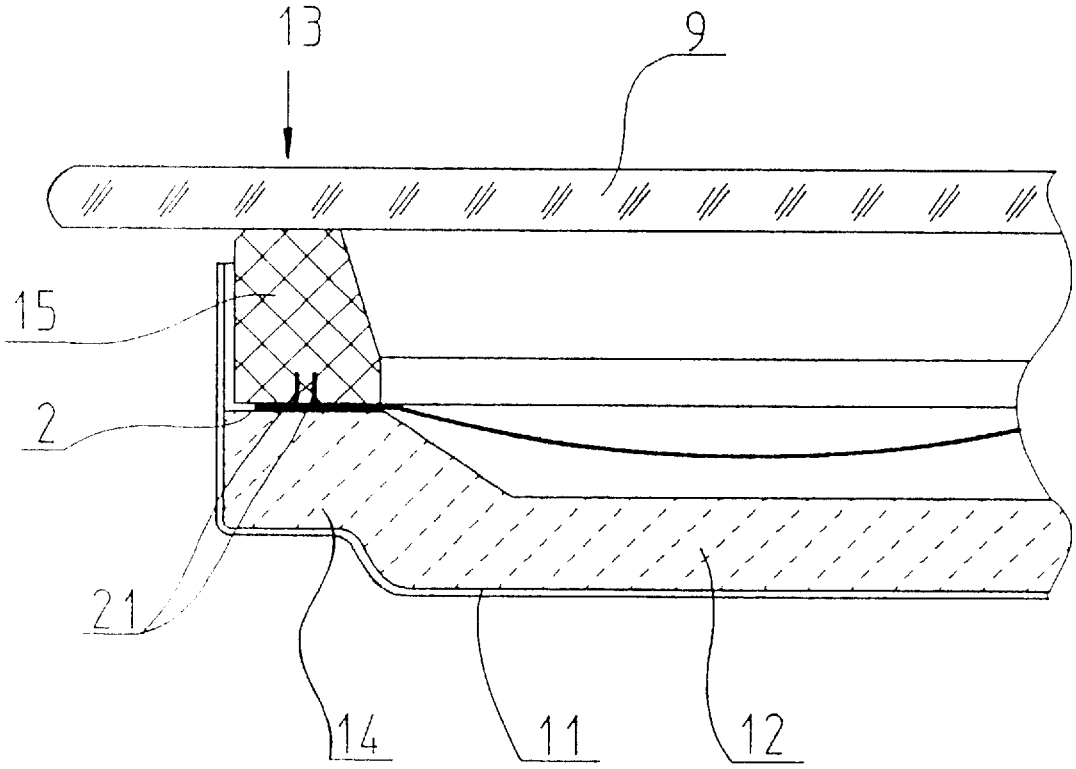
FIG. 11 is a detail view relating to FIGS. 6, 7, 8 and 10 showing a possible fixing of the heating conductor.

Pushed-through spike portions 21 can be provided on the outer holding tongues 2 and/or the inner holding tongues 8 (see FIG. 11). The spike portions 21 can be produced on the metal foil in the region of the holding tongues 2, 8 simply by driving in a pointed tool, thus resulting in points projecting out of the metal foil. When the annular portion 15 (see FIG. 11) and/or the inner holding portion 19 is pressed on, depending on the respective orientation involved, the spike portions engage into the annular portion 15 or the holding portion 19, or into the outer zone 14 or the support portion 17. It is also possible to provide a combination of tongues and/or claws and/or spike portions. It would also be possible to provide claws which are bent over at the ends of the holding tongues 2, 8, instead of the spike portions 21. The spike portions or claws serve for radially securing the heating conductor in the radiant heating body. Instead of the spike portions or claws, it is also possible to provide for frictional clamping of the holding tongues 2, 8 by means of the annular portion 15 and/or the holding portion 19.

Figure 12:
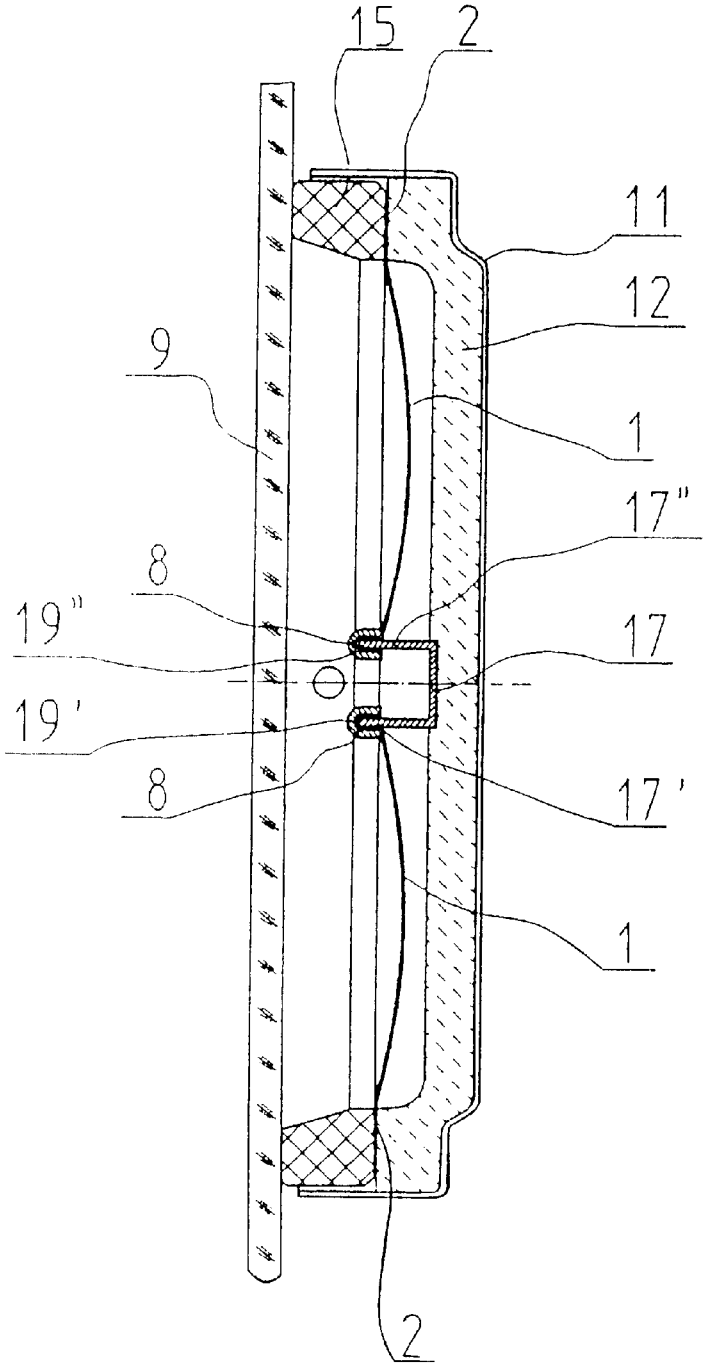
FIGS. 12 to 14 show detail views of further possible fixings.

FIG. 12 shows a further alternative in terms of fixing the inner holding tongues 8. Secured to the insulating bottom 12 as a support portion 17 is a ceramic support member which in the case of the heating conductor shown in FIG. 1 is elongated over the diagonal zone, in the case of the heating conductor shown in FIG. 2 it is of a star-like configuration corresponding to the segment division while in the case of the heating conductor shown in FIGS. 3 and 4 it is in the shape of a circle. The holding tongues 8 are bent in a wrap-over angle over the upper edges 17', 17" of the support portion and are clamped fast in position by means of U-shaped bar-like holding portions 19', 19". That configuration provides for a firm clamping fit which ensures that the holding tongues 8 do not come loose in the event of contraction or expansion caused by the effect of temperature. That is assisted by virtue of the fact that in the event of contraction the heating limbs apply to the holding portions 19', 19" a tilting moment which increases the clamping effect.

Figure 13:
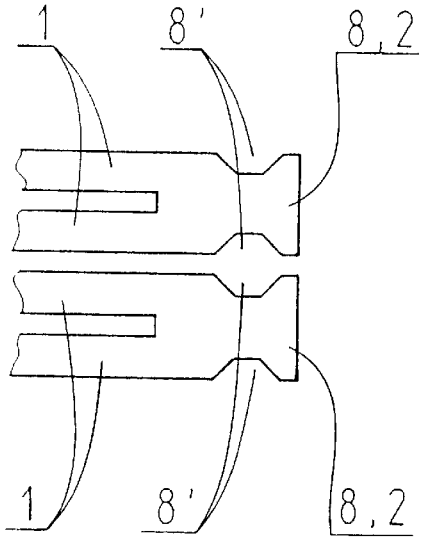
Figure 14:
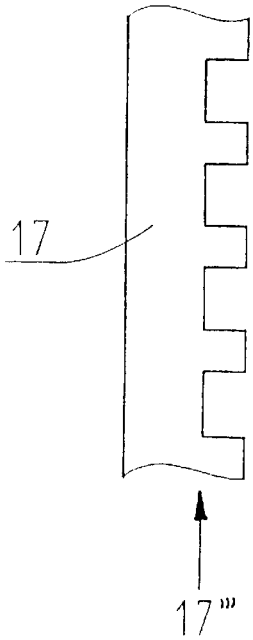

FIGS. 13 and 14 show further alternatives for fixing the holding tongues. Formed on the inner and/or outer holding tongues 8, 2 are indentations or recesses 8' (see FIG. 13), with which there is associated a tooth configuration 17'" of a ceramic support member 17 which is fixed to the insulating bottom 12. A positively locking fit for the holding tongues is achieved by inserting the recesses 8' between the tooth configurations 17'". A similar positively locking connection could also be achieved by a bore-pin pairing.

Assembly is effected substantially in the following manner:

The prefabricated heating conductor is fitted on to the outer zone 14 and the support portion 17. The outer holding tongues 2 and the inner holding tongues 8 are then in supported relationship, in which case the heating limbs 1 extending between them preferably extend at a spacing a from the insulating bottom 12. The underneath large surfaces of the heating limbs 1 face towards the insulating bottom 12. The upward large surfaces of the heating limbs 1 are towards the plane of the glass ceramic plate 9. Only the narrow edges of adjacent heating limbs are disposed opposite each other. Then, to fix the outer holding tongues 2 and the inner holding tongues 8, the annular portion 15 and the inner holding portion 19 are fitted in position. The holding tongues 2, 8 can thus only move to a limited extent or cannot move at all, in which case a certain degree of mobility in the radial direction can be permitted at the outer zone 14 and/or the base portion 17. At any event the holding tongues 2, 8 do not come loose from their fixing locations under the effects of contraction and expansion due to operation of the assembly. The upward large surface of the heating limbs 1 are thus disposed at a spacing b from the glass ceramic plate 9. Thereafter the stabilisation limbs 5 are then possibly severed. In operation, when the heating limbs 1 radiate visibly at temperatures of over 600° C., they suffer from a considerable degree of temperature-induced expansion so that they sag into the free space 22 formed by the spacing a. That sag is indicated at 23 in FIGS. 6 and 10. The spacing a is such that the heating limbs preferably do not touch the insulating bottom 12, when they sag.

A further metal foil portion 20 can be arranged as a temperature sensor on the insulating bottom 12, beneath one or more of the heating limbs 1 (see FIG. 10). It has a temperature-dependent electrical resistance which is a measurement in respect of the temperature of the heating limbs 1 radiating on it. The temperature sensor 20 can be connected to a temperature regulator which is conventional in connection with radiant heating bodies.

Figure 15:
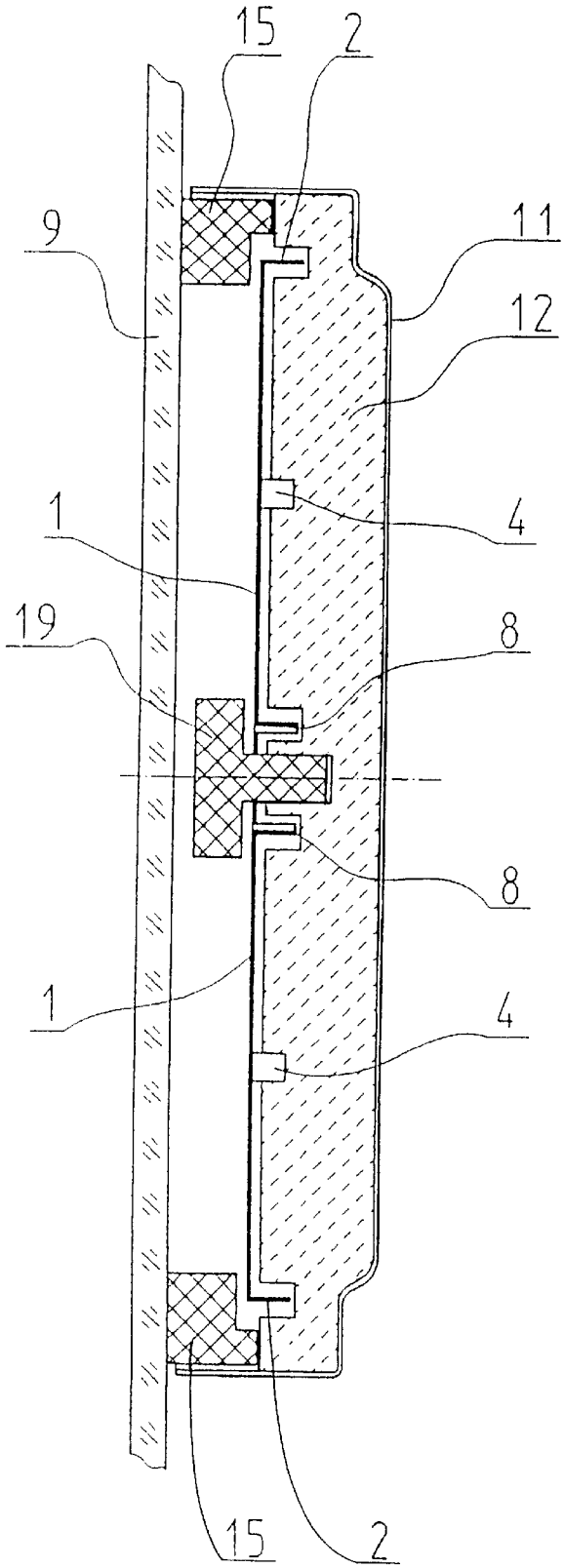
FIG. 15 shows an alternative to FIGS. 6, 7, 8 and 10.

FIG. 15 shows a further embodiment. In this example the insulating bottom 12 does not have an outer zone 14 which is extended upwardly towards the glass ceramic plate 9. Provided at its outer annular rim 13 are recesses 24 into which engage the holding tongues 2, 8 which in this embodiment are angled downwardly. A corresponding configuration with recesses 25 is provided in relation to the inner holding tongues 8. For the purposes of further stabilisation, bent-over lateral holding tongues 4 engage into the insulating bottom 12. In this case thermal expansion effects are absorbed by the play of the holding tongues in the recesses.

Figure 16:
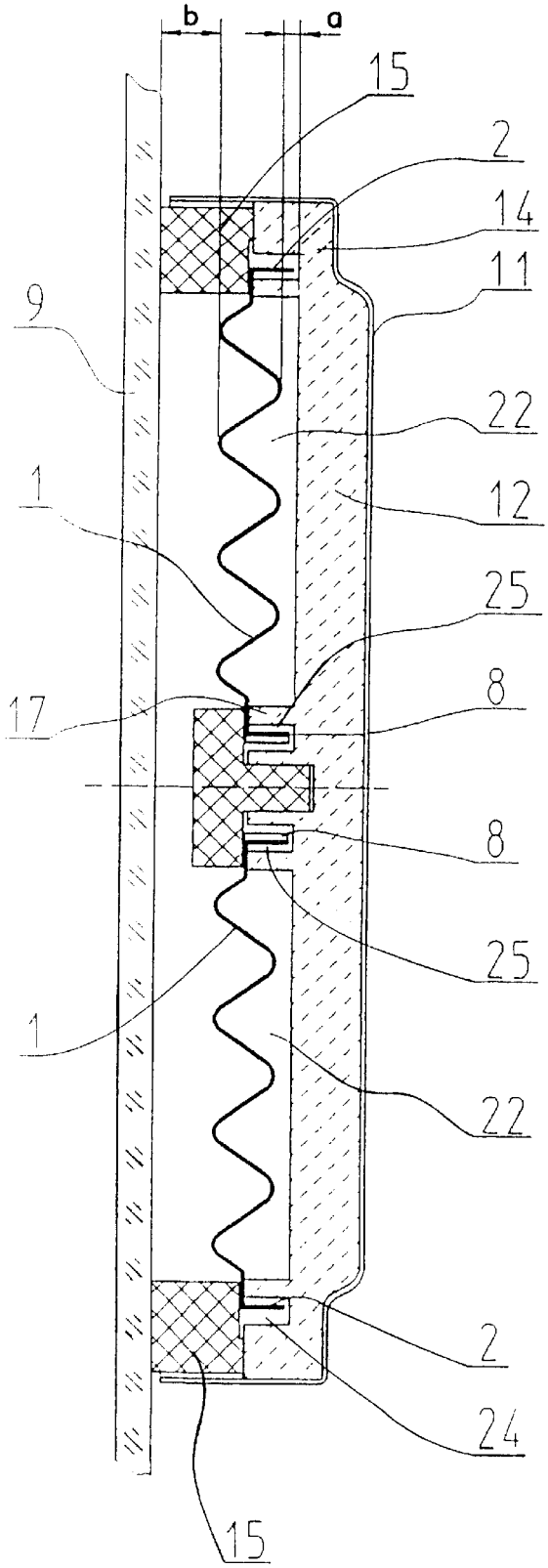
FIG. 16 shows a heating conductor with a corrugated configuration in the longitudinal direction.

In the embodiment shown in FIG. 16 the outer holding tongues 2 are bent over downwardly and engage with play into a recess 24 in the outer zone 14. In a similar manner the downwardly bent inner holding tongues 8 engage into a recess 25 in the base portion 17. The heating conductor is thereby radially secured and thermal expansion phenomena thereof are absorbed.

Figure 17:
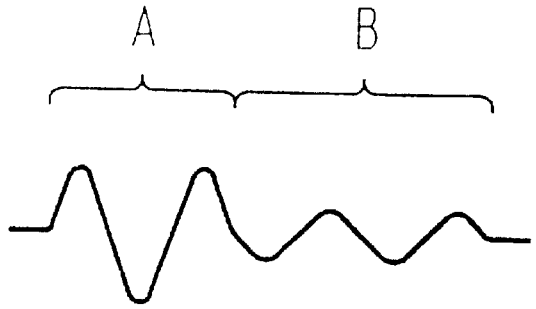
FIG. 17 shows a second form of the corrugation configuration.
Figure 18:
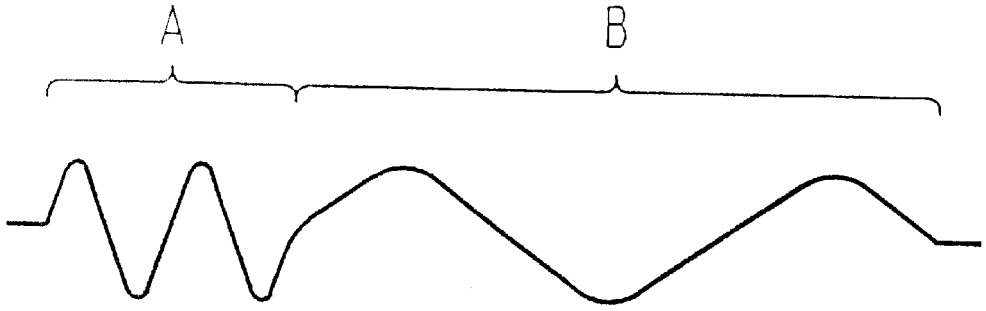
FIG. 18 shows a third form of the corrugation configuration.

In the embodiment shown in FIGS. 16, 17 and 18 the heating limbs 1 are of a corrugated configuration in the longitudinal direction, perpendicularly to the insulating bottom 12. There is the spacing a relative to the insulating bottom 12, between the troughs of the corrugations. The spacing between the peaks of the corrugations and the glass ceramic plate 9 is indicated at b. In FIG. 16 the corrugations are uniform. As shown in FIG. 17 the peaks and troughs of the corrugations are of different heights and depths respectively. As a result the radiation density attained is greater in the zone A with the higher corrugations than in the zone B with the shallower corrugations. As shown in FIG. 18, the corrugation lengths differ. As a result a higher level of radiation density is achieved in the zone A with the shorter corrugation lengths than in the zone B with the longer corrugation lengths. That permits the radiation density to be specifically influenced in the inner and outer regions of the radiant heating body.

Figure 19:
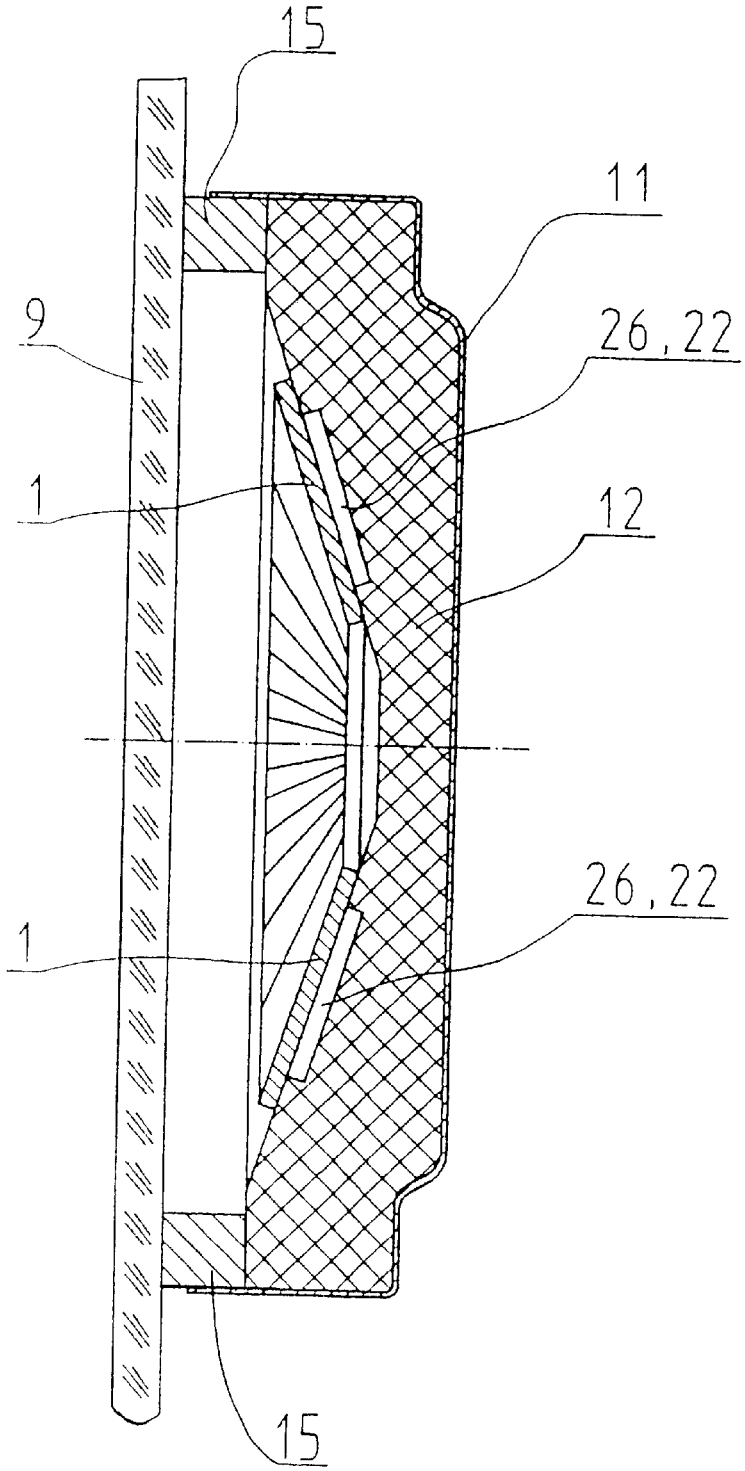
FIG. 19 is a view in cross-section of a further arrangement of the heating conductor in the radiant heating body.

In the embodiment shown in FIG. 19 the insulating bottom 12 is of a concave configuration. The heating limbs 1 extend in a correspondingly inclined arrangement. That arrangement affords the advantage that the heat radiation is focussed towards the glass ceramic plate 9. In this case the free space 22 between the heating limbs 1 and the insulating bottom 12 is formed by a peripherally extending groove 26 or individual pockets, beneath the heating limbs 1. The holding tongues are not shown.

Figure 20:
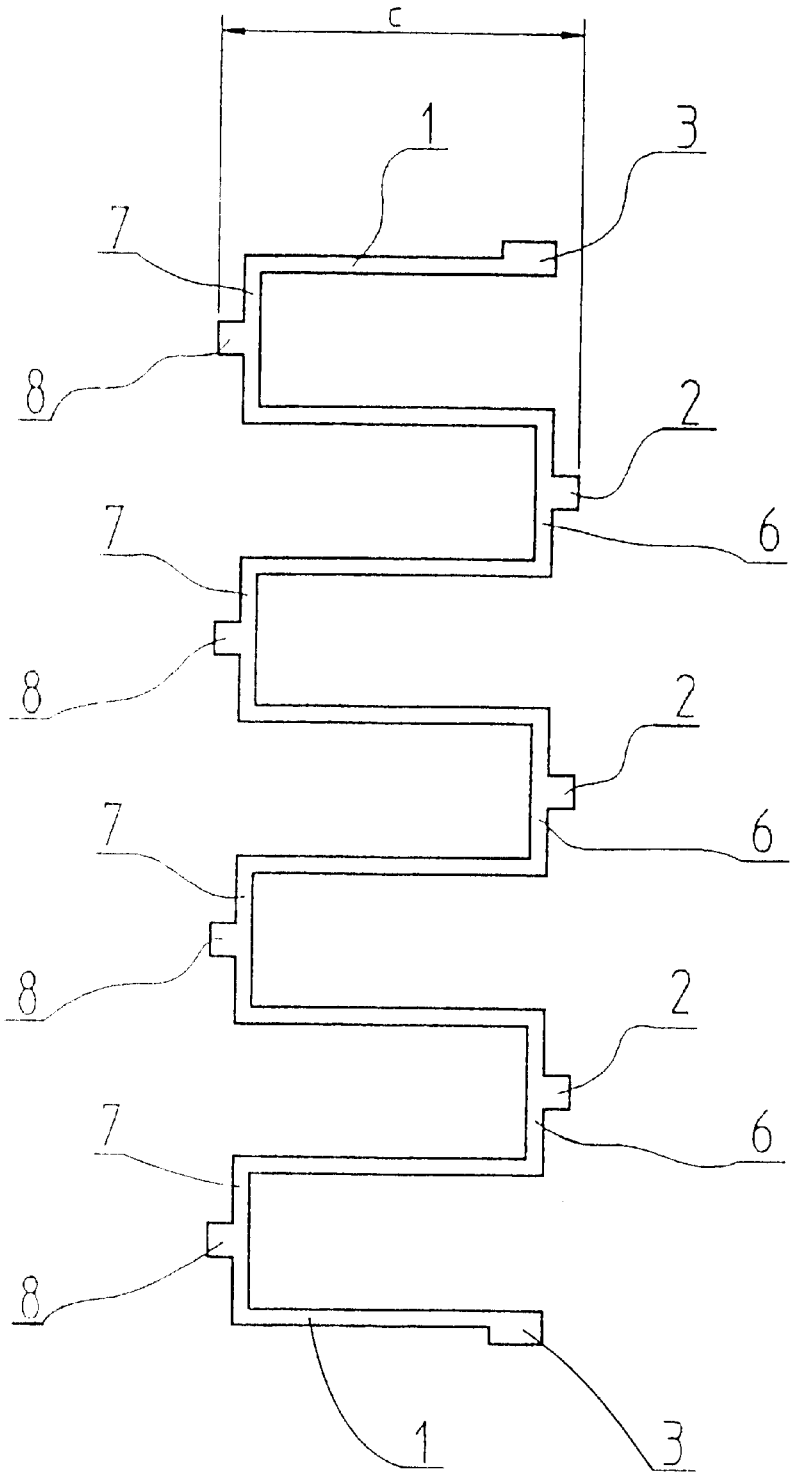
FIG. 20 is a plan view of a meander-like foil portion from which the heating conductor is to be bent.
Figure 21:
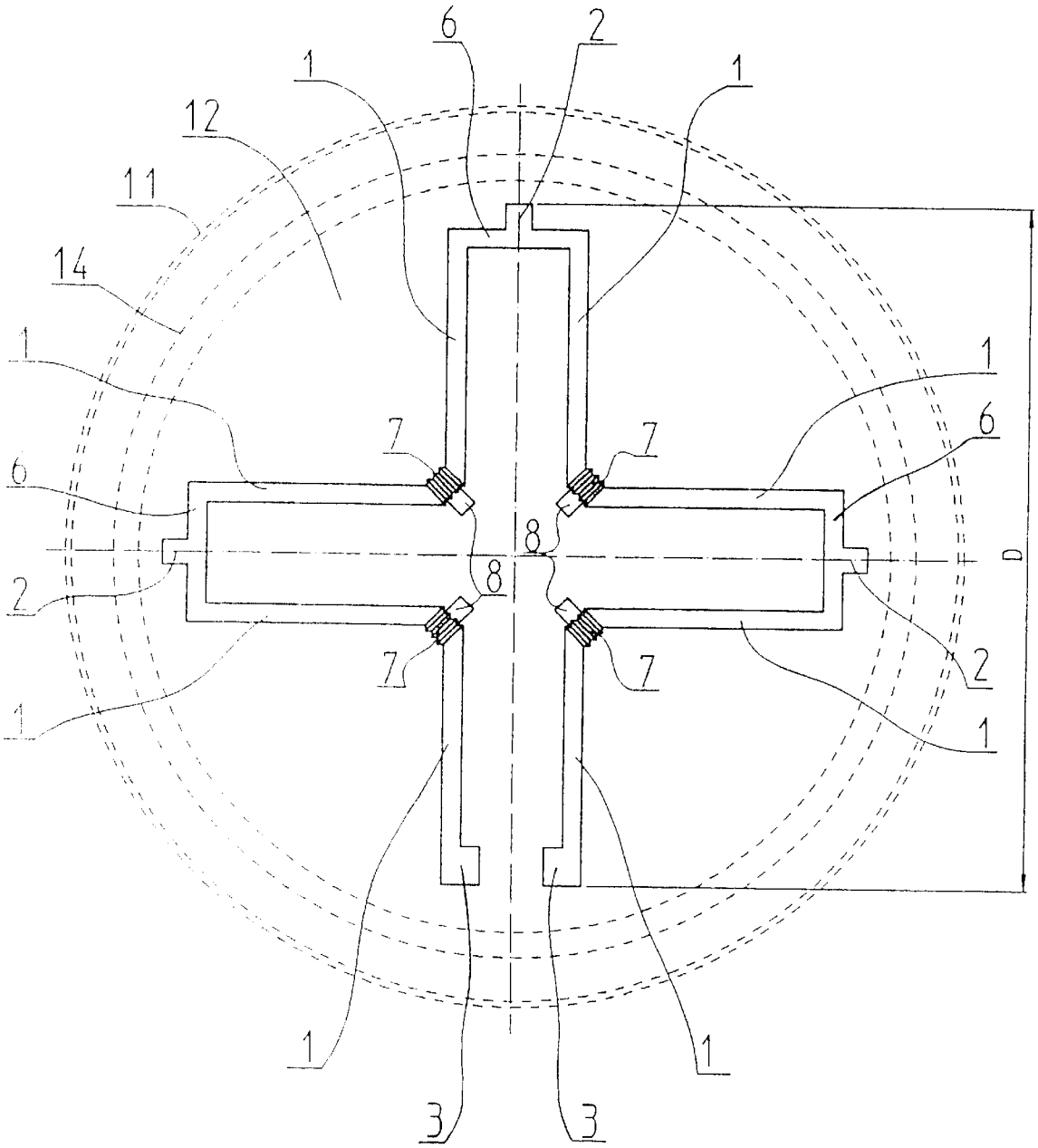
FIG. 21 shows a heating conductor which is bent into its geometrical pattern from the foil portion shown in FIG. 11.

A further embodiment is shown in FIGS. 20 and 21. A straight meander-shaped pattern (see FIG. 20) is separated out of a metal foil strip which is of the width C. The separation cuts at which the adjacent identical patterns are connected are to be found at the current connections 3.

That pattern is bent into the heating conductor shape shown in FIG. 21. For that purpose the inner connecting limbs 7 have to be reduced in length. That is effected by the connecting limbs 7 being corrugated (see FIG. 21). In that configuration, the heating conductor is put on to the insulating bottom 12 and fixed thereto. That construction affords the advantage that in the operation of separating out the pattern from the metal foil, a smaller amount of metal foil waste is produced than if the metal foil strip were of the width D (see FIG. 21).

Figure 22:
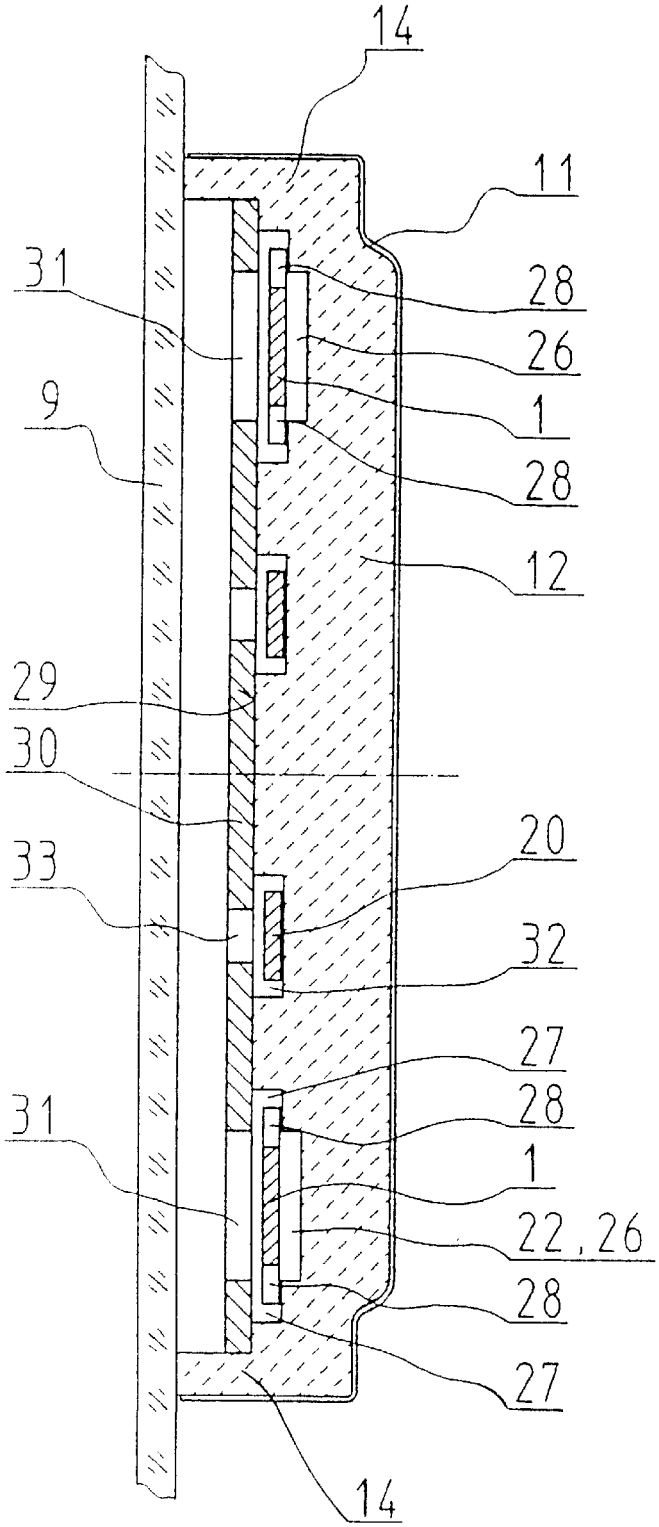
FIG. 22 is a view in cross-section of a further embodiment of the radiant heating body.
Figure 23:
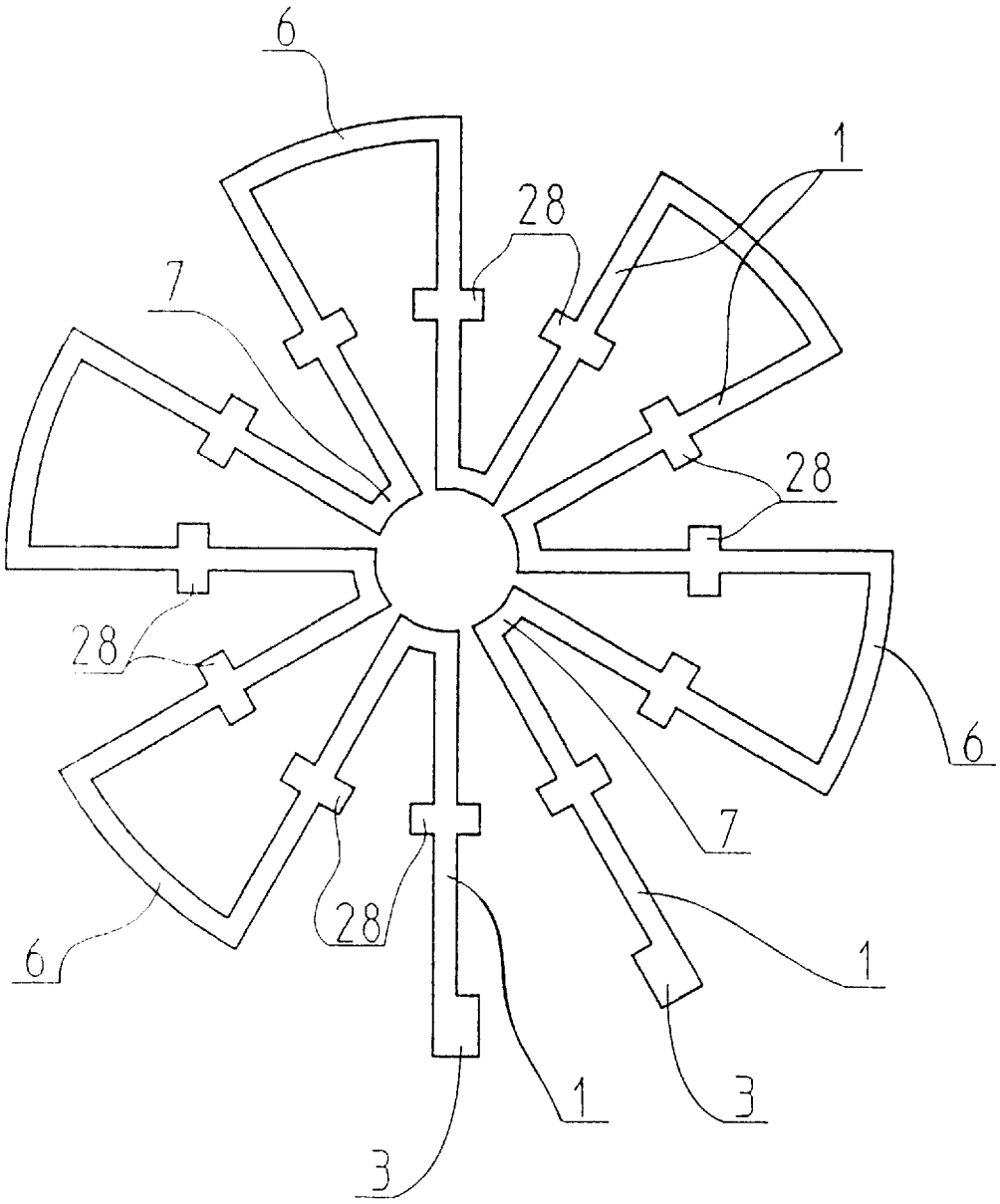
FIG. 23 is a plan view of a heating conductor with lateral holding tongues.

FIGS. 22 and 23 show further alternatives. Provided on the insulating bottom 12 are grooves 26 which are so arranged that they follow the configuration of the heating limbs 1. Those grooves 26 form the free space 22 between the underside of the heating limbs 1 and the insulating bottom 12. The width of the grooves 26 is somewhat greater than the width of the heating limbs 1 (see FIG. 22).

Provided laterally above the grooves 26 are enlargement portions 27 for receiving holding tongues 28 which are formed laterally on the heating limbs 1. Fitted on to the surface zones 29 of the insulating bottom 12, which are at a higher level than the enlargement portions 27 and the grooves 26, is a flat holding portion 30 which is or is not capable of transmitting infra-red radiation and which secures the heating conductor to the insulating bottom 12. Over the heating limbs 1 the plate-shaped holding portion 30 has openings 31 which ensure a free passage for the heat radiation from the heating limb 1 on to the glass ceramic plate 9. The openings 31 are of smaller width than the enlargement portions 27 so that the holding portion 30 can secure the lateral holding tongues 28 in the enlargement portions 27. Thermal expansion of the heating limbs 1 which are possibly corrugated in the above-described manner is accommodated in the grooves 26 and the openings 31.

FIG. 23 shows a heating conductor with lateral holding tongues 28 on the heating limbs 1, which can be arranged on the insulating bottom 12 in the manner described with reference to FIG. 22.

FIG. 22 also shows the arrangement of the temperature sensor 20 in the form of a flat strip, in a groove 32 in the insulating bottom 12. The temperature sensor 20 is also fixed by the holding portion 30. It is thermally coupled by way of the holding portion 30 and openings 33 in the holding portion 30 to the temperature which respectively prevails under the glass ceramic plate 9.

FIGS. 24 to 27 show various other possible ways of fixing the outer holding tongues 2 between the outer zone 14 and the annular portion 15. Those configurations provide that the holding tongues 2 do not pull out under the annular portion 15, by virtue of positively locking engagement and possibly assisted by frictional engagement.

Figure 24:
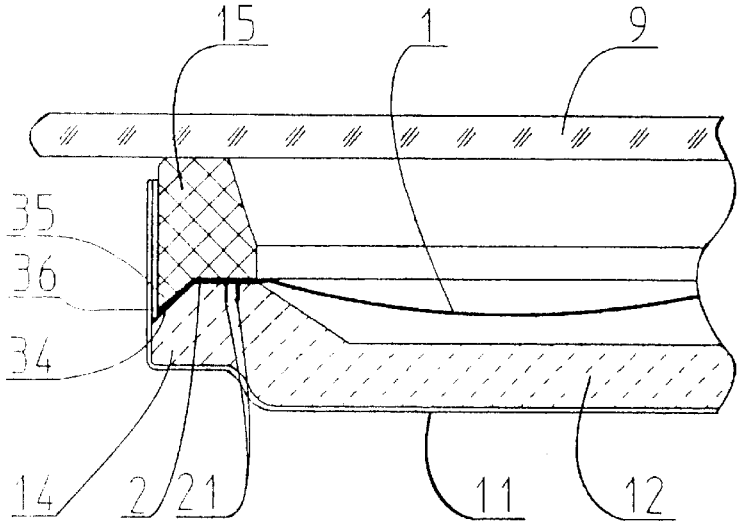
FIGS. 24 to 30 show detail views of further possible fixings of the holding tongues.

In the embodiment shown in FIG. 24 the outer zone 14 has a slope 34 which falls away outwardly towards the dish-like portion 11. A corresponding slope 35 is provided on the annular portion 15. The holding tongues 2 engage with a bent-over portion 36 between the slopes 34 and 35. In that arrangement the bent-over portions 36 can be prefabricated on the holding tongues 2. They can however also be produced by virtue of the holding portion 15, mounted under the glass ceramic plate 9, pressing on to the holding tongues 2. The pressure applied to the bent-over portions 36 by the annular portion 15 produces at the bent-over portions 36 a force component which seeks to pull them outwardly so that the heating limbs 1 are radially tensioned.

Figure 25:
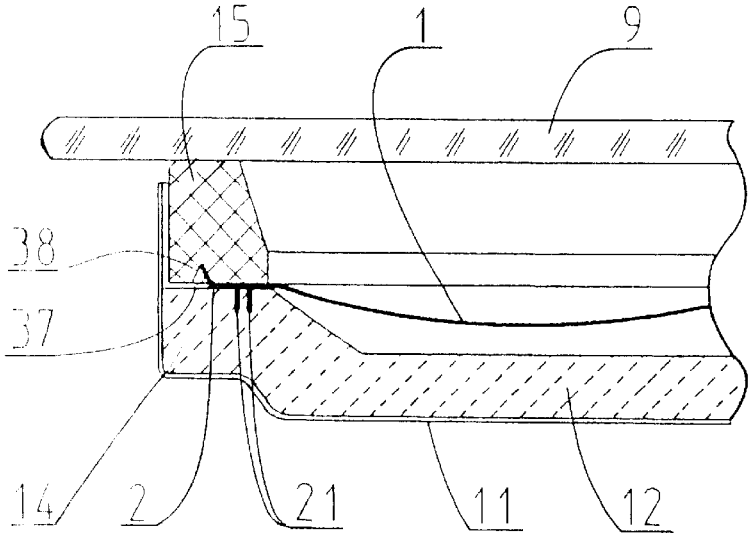
Figure 26:
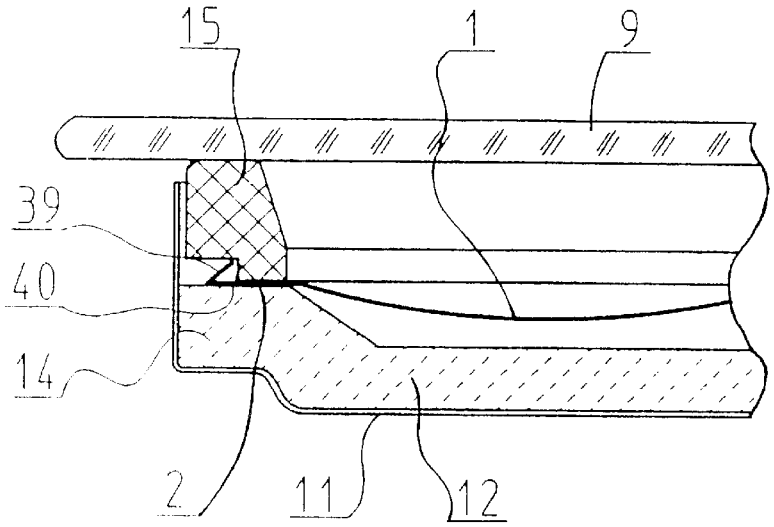

In the embodiment shown in FIG. 25, provided on the holding tongues 2 is an upwardly directed bent-over portion 37 which engages into a recess 38 in the annular portion 15. In the embodiment shown in FIG. 25 the bent-over portion 37 is bent over through less than 90° relative to the plane of the geometrical pattern of the heating conductor. In the embodiment shown in FIG. 26 the bent-over portion 39 of the holding tongue 2 is bent over upwardly through more than 90° relative to the above-mentioned plane, thus resulting in a hook which is fairly stable in respect of shape. Associated therewith is an abutment 40 which is formed by the annular portion 15 and which does not allow the bent-over portion 39 and therewith the holding tongue 2 to slip out between the outer zone 14 and the annular portion 15.

Figure 27:
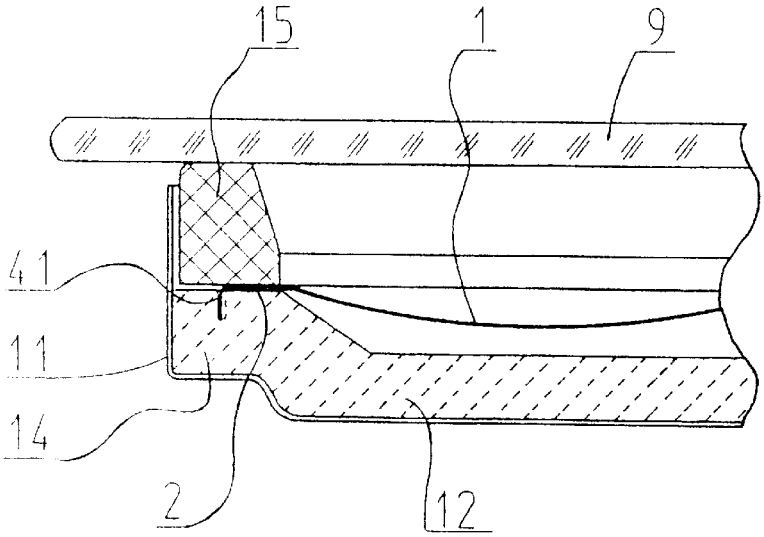

The embodiment shown in FIG. 27 has a downwardly directed bent-over portion 41 on the outer holding tongue 2. As described above in relation to the heating limb 1, the bent-over portion 41 is of a V-shaped or U-shaped configuration in cross-section. As a result it is so stiff that it can be pressed directly into the material of the insulating bottom 12. This material is generally softer than the material of which the annular portion 15 is made. FIGS. 24 and 25 also show the above-described spike portions 21 which are pressed into the outer zone 14 of the insulating bottom 12. These spike portions 21 can also be provided in the embodiments shown in FIGS. 26 and 27.

Figure 28:
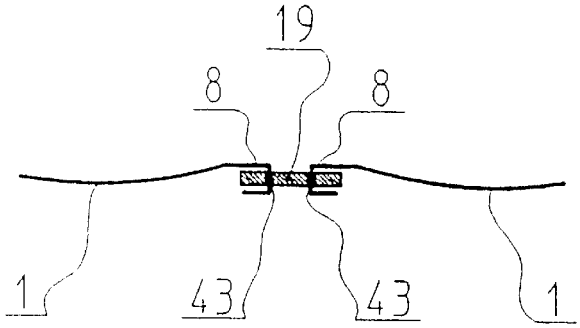
Figure 29:
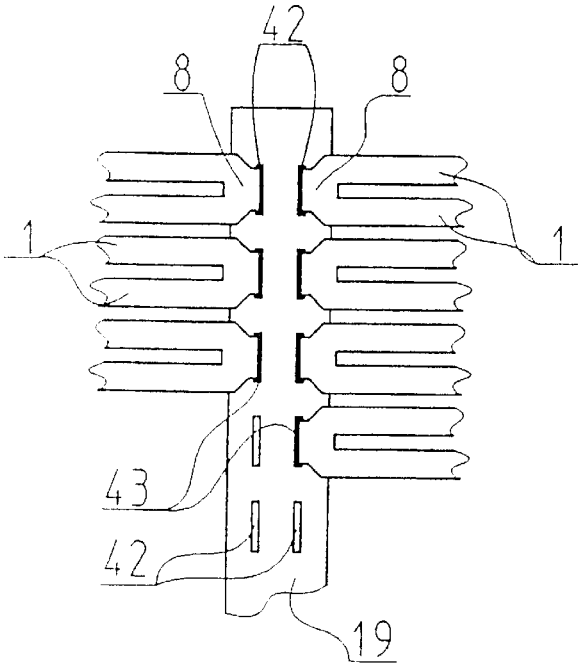
Figure 30:
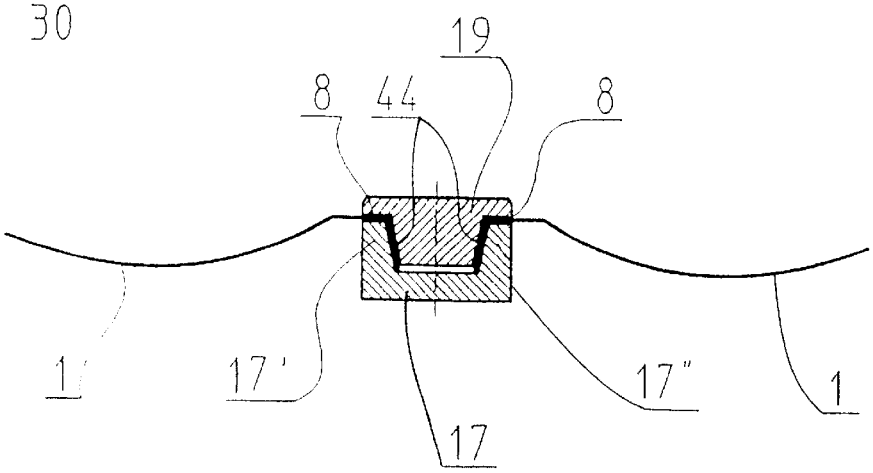

FIGS. 28, 29 and 30 show alternatives for fixing the inner holding tongues 8. As shown in FIGS. 28 and 29, a holding strip or bar portion 19 is provided as the inner holding portion. It has two rows of slots 42, for the inner holding tongues 8 of the heating conductor (see FIG. 1), with a respective specific slot being provided for each holding tongue 8. The holding strip or bar portion 19 comprises for example synthetic resin-bound mica flakes (micanite). The ends of the holding tongues 8 are fitted through the slots 42 and bent over at top and bottom approximately through 90° at the holding strip or bar portion 19 so that they are positively lockingly fixed in the slots 42 (see FIG. 28). That thus provides for fixing the holding tongues 8 in the longitudinal direction R of the heating limbs 1 and the transverse direction Q. The fixing effect in the longitudinal direction R provides that the heating limbs 1 have the necessary tension within the annular portion 15. The fixing effect in the transverse direction Q ensures that the holding tongues 8 cannot slip in such a way that as a result adjacent heating limbs 1 touch.

The holding strip or bar portions 19 shown in FIGS. 28 and 29 can sit on and/or be fixed to an above-described support portion 17 of the insulating bottom 12. The holding strip or bar portion 19 however may also float freely over the insulating bottom 12. The holding tongues 8 are fixed to the holding strip or bar portion 19 before the heating conductor is fitted into the dish-like portion 11.

FIG. 30 shows a configuration for the inner holding portion 19, which is similar to FIGS. 10 and 12. Here bent-over portions 44 of the holding tongues 8 engage into a support portion 17 which is fixed in the insulating bottom 12. The bent-over portions 44 are clamped fast in the support portion 17 by a holding member 19 of ceramic, pressed into the support portion 17. For the heating conductor shown in FIG. 1, the support portion 17 and the holding member 19 are of a strip-like or bar-like shape. For heating conductors in which the inner holding tongues 8 lie on a circle, the support portion 17 and the holding member 19 are of a correspondingly circular configuration.

Instead of the holding tongues 8 being secured to the holding strip or bar portion 19 by bending over, as described above with reference to FIGS. 28 and 29, it is also possible for the holding tongues 8 to be sewn to the holding strip or bar portion 19. A commercially available, heat-resistant yarn or thread, in particular of ceramic fibre material, is used for that purpose. In the sewing procedure the holding tongues 8 and the holding strip or bar portion 19 are pierced. In the end result, the sewing effect also provides for fixing the holding tongues 8 to the holding strip or bar portion 19 in the longitudinal direction R and in the transverse direction Q. If necessary the holding tongues 8 can also be sewn to two mutually superposed holding strip or bar portions 19, in which case the holding tongues 8 are then disposed between the two holding strip or bar portions 19. Sewing to an annular carrier may also be employed in connection with the outer holding tongues 2. In that case the annular carrier and the holding strip or bar portion 19 may form a one-piece shaped component. The sewing operation is conducted prior to the heating conductor being fitted into the dish-like portion 11 or on to the insulating bottom 12. The heating conductor which is sewn on to the shaped component is then fitted in the form of a prefabricated unit into the dish-like portion 11 or on to the insulating bottom 12, with all holding tongues being fixed in their desired positions. The annular portion 15 can thereafter be fitted in place.

Numerous further embodiments are possible by way of example within the framework of the present invention. Thus it is possible for example for partial features of the embodiments to be combined together.

What is claimed is:

1. A radiant heating body for a cooking hob, in particular a glass ceramic cooking hob, having a heating conductor comprising a metal foil and an insulating bottom under the heating conductor, wherein the heating conductor is separated out of said metal foil and extends in a geometrical pattern between the cooking hob and the insulating bottom, the heating conductor pattern forming heating limbs (1) of a thickness which is substantially smaller that their width and whose large surface is directed upwardly, said heating limbs being held at least at an outer annular rim (13) of the insulating body (12), the outer annular rim (13) being formed by an annular raised outer zone (14) of the insulating bottom (12) and an annular portion (15) which is fitted onto the outer zone and which comprises a thermally an electrically insulating material, and wherein said heating limbs include outer holding tongues (2) engaging between the outer zone (14) and the annular portion (15).

2. A radiant heating body according to claim 1, wherein the underside of the heating limbs (1), which faces the insulating body (12), freely extending at least partially at a spacing above the insulating bottom (12).

3. A radiant heating body according to claim 1, wherein said outer holding tongues and inner holding tongues (2, 4, 8, 28) are shaped out of the metal foil in the plane of the geometrical pattern.

4. A radiant heating body according to claim 1, wherein in the outer holding tongues (2) are formed at least at outer locations of the geometrical pattern and are held to the outer annular rim (13) of the insulating bottom (12).

5. A radiant heating body according to claim 3, wherein the outer and inner holding tongues (2, 4, 8, 28) are held on the insulating bottom (12) by a holding portion (15, 19, 30).

6. A radiant heating body according to claim 3, wherein the outer and inner holding tongues (2, 4, 8, 28) are wider than the heating limbs (1) such that during operation the temperature thereof remains below an incandescent temperature.

7. A radiant heating body according to claim 5, wherein the outer and inner holding tongues (2, 4, 8, 28) are held in a locking engagement.

8. A radiant heating body according to claim 3, wherein the outer and inner holding tongues (2, 4, 8, 28) comprise claw-like spike portions (21) pushed-through so as to selectively engage into the material of the insulating bottom (12), and the annular portion (15), and the holding portion (19).

9. A radiant heating body according to claim 3, wherein the outer and inner holding tongues (2, 4, 8, 28) are bent over relative to the plane of the geometrical pattern and engage into recesses (24, 25) provided in the insulating bottom (12) so as to accommodate thermal expansion phenomena of the heating limbs (1).

10. A radiant heating body according to claim 3, wherein the inner holding tongues (8) are arranged at inwardly disposed locations of the flat geometrical pattern of the heating conductor and are held to a support portion (17) of the insulating bottom (12).

11. A radiant heating body according to claim 10, wherein the inner holding tongues (8) are held to the support portion (17) by a holding part (19) which is fixed to the support portion (17).

12. A radiant heating body according to claim 11, wherein the support portion (17) is formed by a support member which is fixed to the insulating bottom (12) and about at least one edge (17', 17") of which the inner holding tongues (8) are bent and clamped by at least one said holding part (19, 19', 19").

13. A radiant heating body according to claim 3, wherein outer holding tongues (2) lie on a peripheral circle of the heating conductor, the inner holding tongues (8) lie on a diagonal zone of the heating conductor, and the heating limbs (1) extend in mutually parallel relationship.

14. A radiant heating body according to claim 3, wherein the outer holding tongues (2) lie on a peripheral circle of the heating conductor and the inner holding tongues (8) lie on at least one concentric circle, the heating limbs (1) extending in parallel in pairs.

15. A radiant heating body according to claim 3, wherein a respective said outer holding tongue (2) and a respective said inner holding tongue (8) connect together heating limbs (1) which extend pairwise in mutually parallel relationship.

16. A radiant heating body according to claim 3, wherein bent-over portions (41) of the outer and inner holding tongues (2, 8) are profiled in cross-section and are pressed into the material of the insulating bottom (12).

17. A radiant heating body according to claim 16, wherein said bent-over portions (36) of the outer holding tongues (2) are clamped between an outwardly downward slope (34) of the insulating bottom (12) and a corresponding slope (35) of the annular portion (15).

18. A radiant heating body according to claim 16, wherein said bent-over portions (37) of the outer holding tongues (20 engage into a recess (38) formed in the annular portion (15).

19. A radiant heating body according to claim 3, wherein an abutment (40) of the annular portion (15) is associated with hook-like bent-over portions (39) of the outer holding tongues (2).

20. A radiant heating body according to claim 3, wherein the outer and inner holding tongues (2, 8) are fitted through slots (42) in a holding part (19) and are bent over the wide sides thereof.

21. A radiant heating body according to claim 20, wherein the holding part (19) selectively rests on a support portion (17) of the insulating bottom (12) or freely extends over the insulating bottom (12).

22. A radiant heating body according to claim 3, wherein the holding tongues (2, 8) are sewn to a holding part.

23. A radiant heating body according to claim 1, wherein a profile which is selectively V-shaped or U-shaped in cross-section is impressed into the heating limbs (1).

24. A radiant heating body according to claim 1, wherein the heating limbs (1) are at least partially corrugated in the longitudinal direction extending perpendicularly to the insulating bottom (12).

25. A radiant heating body according to claim 24, wherein the heights between the corrugation peaks and corrugation troughs and corrugation lengths differ so as to provide a differing radiation density.

26. A radiant heating body according to claim 1, wherein the geometrical pattern of the heating conductor is provided with current connections (30 which are wider that the heating limbs (1) such that during operation the temperature thereof remains below an incandescent temperature.

27. A radiant heating body according to claim 1, wherein a spacing (a) between the underside of the heating limbs (10 and the insulating bottom (12) provides grooves (26) in the insulating bottom (12).

28. A radiant heating body according to claim 1, wherein the geometrical pattern is concavely shaped with respect to a glass ceramic plate (9).

29. A radiant heating body according to claim 28, wherein the insulating bottom (12) is selectively concavely recessed similar to the heating conductor or has a recess formed below the heating conductor.

30. A radiant heating body according to claim 1, wherein a plate (30) which holds the heating conductor to the insulating bottom (120 includes openings (31) in the region of the heating limbs (1).

31. A radiant heating body according to claim 1, wherein the geometrical pattern of the heating conductor is composed from a plurality of portions which are separated out of a flat metal strip.

32. A radiant heating body according to claim 1, wherein the geometrical pattern of the heating conductor is bent out of a linearly-extending meander shape which is separated out of a flat metal foil.

33. A radiant heating body for a cooking hob, in particular a glass ceramic cooking hob, having a heating conductor comprising a metal foil and an insulating bottom under the heating conductor, wherein the heating conductor is separated out of said metal foil and extends in a geometrical pattern between the cooking hob and the insulating bottom, the heating conductor pattern forming heating limbs (1) of a thickness which is substantially smaller that their width and whose large surface is directed upwardly, said heating limbs being held at least at an outer annular rim (13) of the insulating body (12), the underside of the heating limbs (1), which faces towards the insulating body (12) freely extending at least partially at a spacing above the insulating bottom (12), outer and inner holding tongues (2, 4, 8, 28) being shaped out of the metal foil in the plane of the geometrical pattern, said outer holding tongues (2) being formed at least at outer locations of the geometrical pattern and are held to the outer annular rim (13) of the insulating (12), the outer and inner holding tongues (2, 4, 8, 28) being held on the insulating bottom (12) by means of a holding portion (15, 19, 30), the inner holding tongues (8) being arranged inwardly disposed locations of the flat geometrical pattern of the heating conductor and the inner holding tongues (8) being held to a support portion (17) of the insulating bottom (12); and the inner holding tongues (8) being held to the support portion (17) by a holding part (19) which is fixed to the support portion (17).

34. A radiant heating body according to claim 33, wherein the outer annular rim (13) is formed by an annular raised outer zone (14) of the insulating bottom (12) and an annular portion (15) which is fitted onto the outer zone and which comprises a thermally and electrically insulating material, and wherein said heating limbs include outer holding tongues (2) engaging between the outer zone (14) and the annular portion (15).

35. A radiant heating body according to claim 33, wherein the outer and inner holding tongues (2, 4, 8, 28) are held in a locking engagement.

36. A radiant heating body according to claim 33, wherein the outer and inner holding tongues (2, 4, 8, 28) comprise claw-like spike portions (21) pushed-through so as to selectively engage into the material of the insulating bottom (12), the annular portion (15), and the holding portion (19).

37. A radiant heating body according to claim 33, wherein the outer and inner holding tongues (2, 4, 8, 28) are bent over relative to the plane of the geometrical pattern and engage into recesses (24, 25) provided in the insulating bottom (12) so as to accommodate thermal expansion phenomena of the heating limbs (1).

38. A radiant heating body according to claim 33, wherein the support portion (17) is formed by a support member which is fixed to the insulating bottom (12) and about at least one edge (17', 17") of which the inner holding tongues (8) are bent and clamped by at least one said holding portion (19, 19', 19").

39. A radiant heating body according to claim 33, wherein the outer holding tongues (2) lie on a peripheral circle of the heating conductor, the inner holding tongues (8) lie on a diagonal zone of the heating conductor, and the heating limbs (1) extend in mutually parallel relationship.

40. A radiant heating body according to claim 33, wherein the outer holding tongues (2) lie on a peripheral circle of the heating conductor and the inner holding tongues (8) lie on at least one concentric circle, the heating limbs (1) extending parallel in pairs.

41. A radiant heating body according to claim 33, wherein a respective said outer holding tongue (2) and a respective said inner holding tongue (8) connect together heating limbs (1) which extend pairwise in mutually parallel relationship.

42. A radiant heating body according to claim 33, wherein bent-over portions (41) of the outer and inner holding tongues (2, 8) are profiled in cross-section and are pressed into the material of the insulating bottom (12).

43. A radiant heating body according to claim 42, wherein said bent-over portions (36) of the outer holding tongues (2) are clamped between an outwardly downward slope (34) of the insulating bottom (12) and a corresponding slope (35) of the annular portion (15).

44. A radiant heating body according to claim 42, wherein said bent-over portions (37) of the outer holding tongues (2) engage into a recess (38) formed in the annular portion (15).

45. A radiant heating body according to claim 33, wherein an abutment (40) of the annular portion (15) is associated with hook-like bent-over potions (39) of the outer holding tongues (2).

46. A radiant heating body according to claim 33, wherein the outer and holding tongues (2, 8) are fitted through slots (42) in a holding part (19) and are bent over at the wide sides thereof.

47. A radiant heating body according to claim 46, wherein the holding part (19) selectively rests on a support portion (17) of the insulating bottom (12) or freely extends over the insulating bottom (12).

48. A radiant heating body according to claim 33, wherein the holding tongues (2, 8) are sewn to a holding part.

49. A radiant heating body according to claim 33, wherein a profile which is selectively V-shaped or U-shaped in cross-section is impressed into the heating limbs (1).

50. A radiant heating body according to claim 33, wherein the heating limbs (1) are at least partially corrugated in the longitudinal direction extending perpendicularly to the insulating bottom (12).

51. A radiant heating body according to claim 50, wherein the heights between the corrugation peaks and lengths between corrugation troughs vary so as to provide a differing radiation density.

52. A radiant heating body according to claim 33, wherein the geometrical pattern of the heating conductor is provided with current connections (3) which are wider than the heating limbs (1) such that during operation the temperature thereof remains below an incandescent temperature.

53. A radiant heating body according to claim 33, wherein a spacing (a) between the underside of the heating limbs (1) and the insulating bottom (12) provides grooves (26) in the insulating bottom (12).

54. A radiant heating body according to claim 33, wherein the geometrical pattern is concavely shaped with respect to a glass ceramic plate (9).

55. A radiant heating body according to claim 54, wherein the insulating bottom (12) is selectively concavely recessed similar to the heating conductor or has a recess formed below the heating conductor.

56. A radiant heating body according to claim 33, wherein a plate (30) which holds the heating conductor to the insulating bottom (12) includes openings (31) in the region of the heating limbs (1).

57. A radiant heating body according to claim 33, wherein the geometrical pattern of the heating conductor is composed from a plurality of portions which are separated out of a flat metal strip.

58. A radiant heating body according to claim 33, wherein the geometrical pattern of the heating conductor is bent out of a straight meander shape which is separated out of a flat metal foil.

59. A radiant heating body according to claim 33, wherein the outer and inner holding tongues (2, 4, 8, 28) are wider than the heating limbs (1) such that during operation the temperature thereof remains below an incandescent temperatue.

* * * * *